US008967780B2

(12) United States Patent
Tomoguchi et al.

(10) Patent No.: US 8,967,780 B2
(45) Date of Patent: Mar. 3, 2015

(54) LIQUID CARTRIDGE

(71) Applicants: Suguru Tomoguchi, Okazaki (JP); Masataka Kamiya, Owariasahi (JP)

(72) Inventors: Suguru Tomoguchi, Okazaki (JP); Masataka Kamiya, Owariasahi (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/166,193

(22) Filed: Jan. 28, 2014

(65) Prior Publication Data

US 2014/0139586 A1 May 22, 2014

Related U.S. Application Data

(63) Continuation-in-part of application No. PCT/JP2011/004264, filed on Jul. 28, 2011.

(51) Int. Cl.
*B41J 2/175* (2006.01)
*B41J 29/38* (2006.01)

(52) U.S. Cl.
CPC ..... *B41J 2/17546* (2013.01); *B41J 2/17513* (2013.01); *B41J 2/1752* (2013.01); *B41J 2/17523* (2013.01); *B41J 2/1753* (2013.01); *B41J 2/17553* (2013.01); *B41J 29/38* (2013.01)
USPC ..... 347/86; 347/19

(58) Field of Classification Search
USPC ..... 347/19, 86
See application file for complete search history.

(56) References Cited

U.S. PATENT DOCUMENTS

2007/0268347 A1* 11/2007 Amano et al. ..... 347/86
2010/0085398 A1* 4/2010 Nakamura ..... 347/19
2010/0110154 A1* 5/2010 Iwamura et al. ..... 347/86

FOREIGN PATENT DOCUMENTS

JP 2007-331383 A 12/2007
JP 2010-82881 A 4/2010

OTHER PUBLICATIONS

International Search Report and Written Opinion issued in PCT/JP2011/004264, mailed Aug. 30, 2011.

* cited by examiner

*Primary Examiner* — Geoffrey Mruk
*Assistant Examiner* — Scott A Richmond
(74) *Attorney, Agent, or Firm* — Merchant & Gould PC

(57) ABSTRACT

Second and third outer surfaces intersect a first outer surface, and are spaced from each other. A sensor-signal output terminal is disposed on the first outer surface. A discharge port is disposed on the second outer surface. A channel member is closer to the second outer surface than a liquid storing section is. First and second directions are perpendicular to the first and second outer surfaces, respectively. A third direction is perpendicular to the first and second directions. When a space is divided by an imaginary line parallel to the first direction, as viewed from the third direction, into a first region in which the channel member is disposed and a second region in which the liquid storing section is disposed, the sensor and terminal are disposed in the first region. The liquid channel extends linearly in the second direction. The sensor and terminal are aligned in the first direction.

15 Claims, 15 Drawing Sheets

LIQUID CARTRIDGE

CROSS REFERENCE TO RELATED APPLICATIONS

This is a Continuation-In-Part application of International Application No. PCT/JP2011/004264 filed Jul. 28, 2011. The entire disclosure of the prior application is hereby incorporated by reference in its entirety.

TECHNICAL FIELD

The invention relates to a liquid cartridge that stores liquid.

BACKGROUND

According to a known liquid cartridge, when an ink cartridge is mounted on a main unit of an inkjet recording apparatus, an electrode provided at a mounting section and a resistance label provided at the cartridge make contact with each other so that electrical connection is obtained. Thus, it is detected that the cartridge is mounted on the mounting section.

SUMMARY

According to the above-mentioned technology, however, although it can be detected that the liquid cartridge is mounted on the mounting section, fluid communication between the liquid storing section and a liquid ejecting head cannot be detected appropriately. Also, it is expected to improve space efficiency of wiring for detection.

In view of the foregoing, the invention provides a liquid cartridge including a housing, a liquid storing section, a channel member, a movable member, a sensor, a sensor-signal output terminal, and a wiring line. The housing has a space therein. The liquid storing section is provided in the housing and is configured to store liquid. The channel member is provided in the housing and is formed with a liquid channel having one end and another end. The one end is in fluid communication with the liquid storing section. The another end is in fluid communication with outside to serve as a discharge port for discharging liquid to the outside. The movable member is movable in the liquid channel. The sensor is configured to generate a signal based on a position of the movable member in the liquid channel. The sensor-signal output terminal is connected electrically with the sensor and is configured to output the signal to the outside. The wiring line connects the sensor with the sensor-signal output terminal. The housing includes a first outer surface, a second outer surface, and a third outer surface. The second outer surface and the third outer surface each connects to the first outer surface and intersects the first outer surface. The second outer surface and the third outer surface are spaced from and in confrontation with each other. The sensor-signal output terminal is disposed on the first outer surface. The discharge port is disposed on the second outer surface. The channel member is disposed at a position closer to the second outer surface than the liquid storing section is. The liquid storing section is disposed at a position closer to the third outer surface than the channel member is. A first direction is defined as a direction perpendicular to the first outer surface. A second direction is defined as a direction perpendicular to the second outer surface. A third direction is defined as a direction perpendicular to both the first direction and the second direction. When the space in the housing is divided by an imaginary line parallel to the first direction, as viewed from the third direction, into a first region in which the channel member is disposed and a second region in which the liquid storing section is disposed, the sensor and the sensor-signal output terminal are disposed in the first region. The liquid channel extends linearly in the second direction. The sensor and the sensor-signal output terminal are arranged to be aligned in the first direction.

According to another aspect, the invention also provides a liquid cartridge including a housing, a liquid storing section, a channel member, a movable member, a sensor, a sensor-signal output terminal, and a wiring line. The housing has a space therein. The liquid storing section is provided in the housing and is configured to store liquid. The channel member is provided in the housing and is formed with a liquid channel having one end and another end. The one end is in fluid communication with the liquid storing section. The another end is in fluid communication with outside to serve as a discharge port for discharging liquid to the outside. The movable member is movable in the liquid channel. The sensor is configured to generate a signal based on a position of the movable member in the liquid channel. The sensor-signal output terminal is connected electrically with the sensor and is configured to output the signal to the outside. The wiring line connects the sensor with the sensor-signal output terminal The housing includes a first outer surface, a second outer surface, and a third outer surface. The second outer surface and the third outer surface each connects to the first outer surface and intersects the first outer surface. The second outer surface and the third outer surface are spaced from and in confrontation with each other. The sensor-signal output terminal is disposed on the first outer surface. The discharge port is disposed on the second outer surface. The channel member is disposed at a position closer to the second outer surface than the liquid storing section is. The liquid storing section is disposed at a position closer to the third outer surface than the channel member is. A first direction is defined as a direction perpendicular to the first outer surface. A second direction is defined as a direction perpendicular to the second outer surface. When the space in the housing is divided by an imaginary line parallel to the second outer surface, as viewed from a direction parallel to both the first outer surface and the second outer surface, into a first region in which the channel member is disposed and a second region in which the liquid storing section is disposed, the sensor and the sensor-signal output terminal are disposed in the first region. The liquid channel extends linearly in the second direction. The sensor and the sensor-signal output terminal are arranged to be aligned in the first direction. With this arrangement, effects similar to those described above are obtained.

According to still another aspect, the invention also provides a liquid cartridge including a housing, a liquid storing section, a channel member, a sensor, a sensor-signal output terminal, and a wiring line. The housing has a space therein. The liquid storing section is provided in the housing and is configured to store liquid. The channel member is provided in the housing and is formed with a liquid channel having one end and another end. The one end is in fluid communication with the liquid storing section. The another end is in fluid communication with outside to serve as a discharge port for discharging liquid to the outside. The channel member is so configured that a hollow member can be inserted through the discharge port. The sensor is configured to generate a signal based on a position of the hollow member in the liquid channel. The sensor-signal output terminal is connected with the sensor and is configured to output the signal to the outside. The wiring line connects the sensor with the sensor-signal output terminal. The housing includes a first outer surface, a second outer surface, and a third outer surface. The second outer surface and the third outer surface each connects to the first outer surface and intersects the first outer surface. The second outer surface and the third outer surface are spaced from and in confrontation with each other. The sensor-signal output terminal is disposed on the first outer surface. The discharge port is disposed on the second outer surface. The channel member is disposed at a position closer to the second outer surface than the liquid storing section is. The liquid storing section is disposed at a position closer to the third outer surface than the channel member is. A first direction is defined as a direction perpendicular to the first outer surface. A second direction is defined as a direction perpendicular to the second outer surface. A third direction is defined as a direction perpendicular to both the first direction and the second direction. When the space in the housing is divided by an imaginary line parallel to the first direction, as viewed from the third direction, into a first region in which the channel member is disposed and a second region in which the liquid storing section is disposed, the sensor and the sensor-signal output terminal are disposed in the first region. The liquid channel extends linearly in the second direction. The sensor and the sensor-signal output terminal are arranged to be aligned in the first direction.

BRIEF DESCRIPTION OF THE DRAWINGS

Embodiments in accordance with the invention will be described in detail with reference to the following figures wherein:

FIGS. 5A and 5B are partial cross-sectional views of a region V shown in FIG. 4, wherein FIG. 5A shows a case in which a hollow needle of the printer is not inserted in a plug and a valve is in a closed state, and FIG. 5B shows a case in which the hollow needle of the printer is inserted in the plug and the valve is in an open state;

FIGS. 9A and 9B show the configuration of wiring in the cartridge, wherein FIG. 9A is a schematic side view and FIG. 9B is a schematic plan view each showing the configuration of wiring in the cartridge;

FIGS. 10A through 10C are schematic plan views showing a process in which the cartridge is mounted onto the printer, wherein FIG. 10A shows a state before the cartridge is mounted onto the printer, FIG. 10B shows a state in which the cartridge is inserted to a position where the terminal of the cartridge contacts a terminal of the printer, and FIG. 10C shows a state in which a hollow needle supported by a support body has moved in a direction of a filled arrow and penetrated the plug of the cartridge;

DETAILED DESCRIPTION

A liquid cartridge according to some aspects of the invention will be described while referring to the accompanying drawings. In the following description, the expressions "upper" and "lower" are used to define the various parts when a liquid ejecting device on which a liquid cartridge is mounted is disposed in an orientation in which it is intended to be used.

Figure 1:
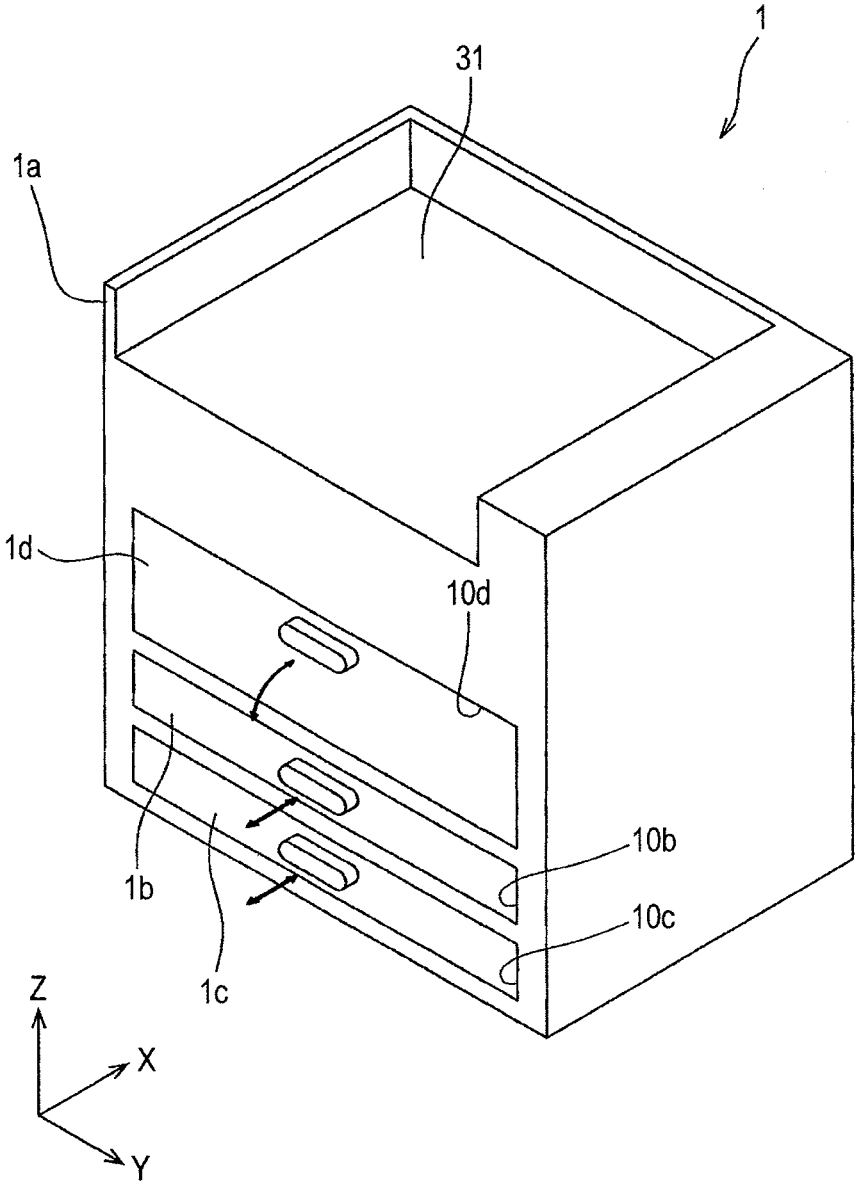
FIG. 1 is a perspective view showing the exterior of an inkjet printer according to an embodiment of the invention.

First, the overall configuration of an inkjet-type printer 1 according to an embodiment will be described while referring to FIG. 1.

The printer 1 has a housing 1*a* having a rectangular parallelepiped shape. A paper discharging section 31 is provided on a top plate of the housing 1*a*. Three openings 10*d*, 10*b*, and 10C are provided on a front surface (the surface on the near left side in the drawing of FIG. 1) of the housing 1*a* in this order from the top. The opening 10*b* is for inserting a paper supplying unit 1*b* inside the housing 1*a*. The opening 10*c* is for inserting a cartridge unit 1*c* inside the housing 1*a*. The opening 10*d* is fitted with a door 1*d* that can open and close pivotally about a horizontal axis on its lower end. The door 1*d* is disposed in confrontation with a conveying unit 21 (see FIG. 2) in a main scanning direction X (the direction perpendicular to the front surface of the housing 1*a*) of the housing 1*a*.

Next, the internal structure of the printer 1 will be described with reference to FIG. 2.

The internal space of the housing 1*a* can be divided into spaces A, B, and C in this order from the top, for description purposes. In the space A, two heads 2, the conveying unit 21, and a controller 100 are disposed. The two heads 2 eject black ink and pre-coat liquid (hereinafter, these may be collectively referred to as "liquid"), respectively. The conveying unit 21 conveys paper P. The controller 100 controls operations of each section of the printer 1. In the space B, the paper supplying unit 1*b* is disposed. In the space C, the cartridge unit 1*c* is disposed. Within the printer 1, a paper conveying path along which paper P is conveyed is formed from the paper supplying unit 1*b* to a paper discharging section 31 along thick arrows in FIG. 2.

The controller 100 includes a CPU (Central Processing Unit), a ROM (Read Only Memory), a RAM (Random Access Memory: including non-volatile RAM), I/F (Interface), and the like. The ROM stores programs executed by the CPU, various constant data, and the like. The RAM can temporarily store data (image data etc.) that are required when the programs are executed. The controller 100 performs data transmission and reception with a memory 141 and Hall elements 71 of a cartridge 40, data transmission and reception with an external device (a personal computer connected with the printer 1 etc.), and the like, via the I/F.

The paper supplying unit 1*b* includes a paper supplying tray 23 and a paper supplying roller 25. Of these, the paper supplying tray 23 is detachable from the housing 1*a* in the main scanning direction X. The paper supplying tray 23 is a box which is opened upward, and can accommodate paper P in a plurality of sizes. The paper supplying roller 25 rotates by driving of a paper supplying motor 125 (see FIG. 11) under controls by the controller 100, and picks up paper P at the topmost position in the paper supplying tray 23. The paper P picked up by the paper supplying roller 25 is sent to the conveying unit 21 while being guided by guides 27*a* and 27*b* and being nippingly held by a pair of feed rollers 26.

The conveying unit 21 includes two belt rollers 6 and 7, an endless-type conveying belt 8 looped around the both rollers 6 and 7. The belt roller 7 is a drive roller and, under controls by the controller 100, rotates in the clockwise direction in FIG. 2 by driving of a conveying motor 127 (see FIG. 11) connected with its shaft. The belt roller 6 is a follow roller, and rotates in the clockwise direction in FIG. 2 by following the movement of the conveying belt 8 caused by rotation of the belt roller 7.

A platen 19 having a rectangular parallelepiped shape is disposed within the loop of the conveying belt 8 so as to confront the two heads 2. The upper loop of the conveying belt 8 is supported by the platen 19 from the inner peripheral surface side, so that an outer peripheral surface 8*a* of the conveying belt 8 extends parallel to lower surfaces 2*a* (ejecting surfaces in which a large number of ejection ports for ejecting liquid is formed) of the two heads 2 with a predetermined gap therebetween.

A silicone layer with slight adherence is formed on the outer peripheral surface 8*a* of the conveying belt 8. The paper P sent from the paper supplying unit 1*b* to the conveying unit 21 is pressed against the outer peripheral surface 8*a* of the conveying belt 8 by a pressing roller 4, and is subsequently conveyed in a sub-scanning direction Y along the thick arrows while being held on the outer peripheral surface 8*a* by adhesive force.

Here, the sub-scanning direction Y is a direction parallel to the conveying direction of paper P by the conveying unit 21. The main scanning direction X is a direction perpendicular to the sub-scanning direction Y and parallel to a horizontal surface. Each of the main scanning direction X and the sub-scanning direction Y is perpendicular to a vertical direction Z.

When the paper P passes a position directly below each head 2, the heads 2 are driven under controls by the controller 100 so that liquid (black ink, and pre-coat liquid depending on situations) is ejected toward the top surface of the paper P from the lower surface 2*a* of each head 2, thereby recording a desired image on the paper P. Then, the paper P is separated from the outer peripheral surface 8*a* of the conveying belt 8 by a separation plate 5, is conveyed upward while being guided by guides 29*a* and 29*b* and being nippingly held by two pairs of rollers 28, and is discharged onto the paper discharging section 31 through an opening 30 formed at an upper section of the housing 1*a*. One roller of each pair of rollers 28 rotates by driving of a feed motor 128 (see FIG. 11) under controls by the controller 100.

The pre-coat liquid is liquid having, for example, an effect of improving density (an effect of improving density of ink ejected on paper P), an effect of preventing running of ink and permeation of ink (a phenomenon that ink ejected on the top surface of paper P penetrates the layer of paper P and runs on the bottom surface), an effect of improving chromogenic characteristics and quick drying characteristics, an effect of suppressing wrinkles and curl of paper P subsequent to ejection of ink, and the like. As the pre-coat liquid, for example, liquid containing multivalent metal salt such as cationic polymer, magnesium salt, etc. may be used.

The head 2 that ejects pre-coat liquid is disposed at an upstream side of the head 2 that ejects black ink with respect to the conveying direction of paper P.

Figure 2:
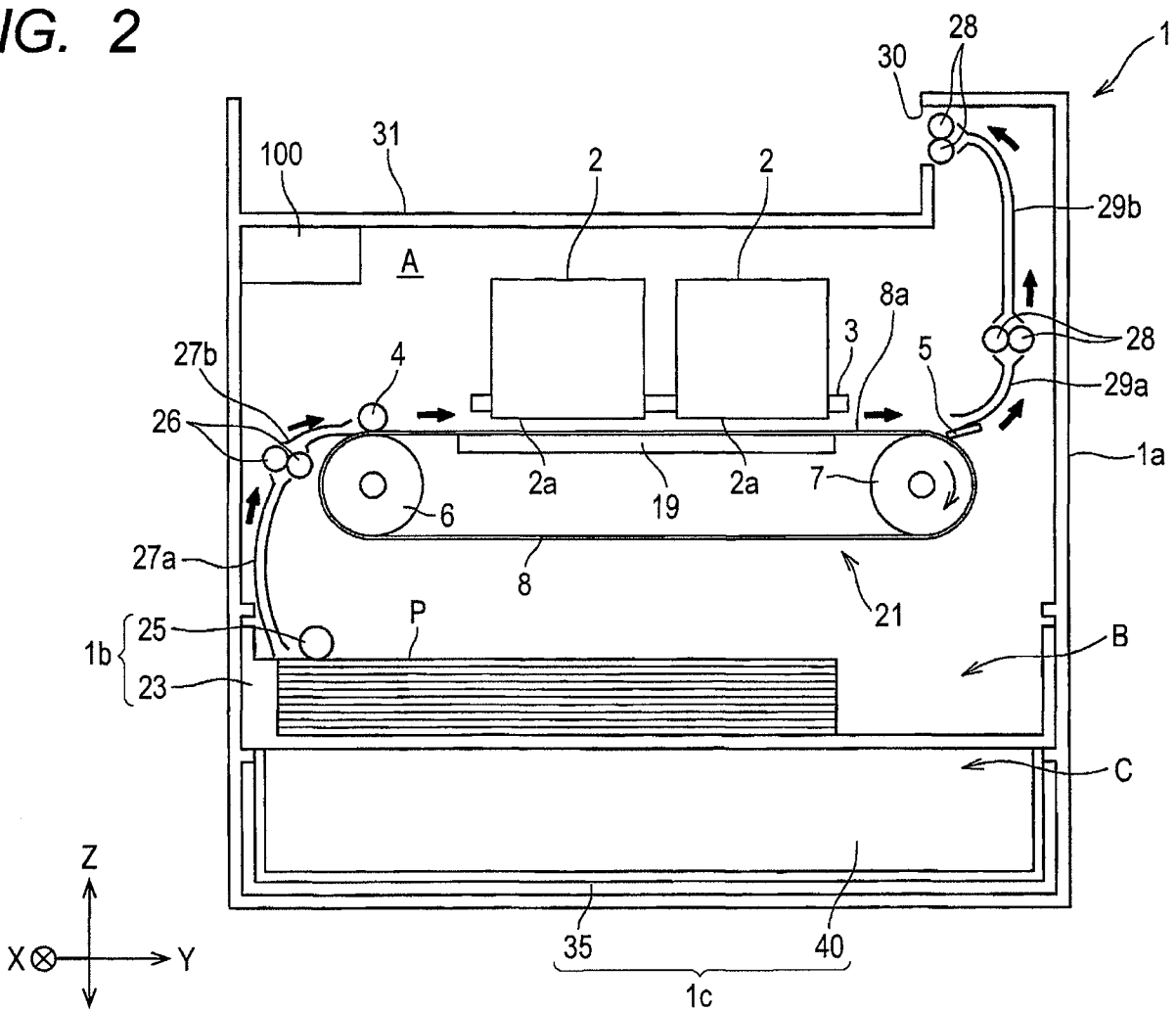
FIG. 2 is a schematic cross-sectional view showing the internal structure of the printer.

Each head 2 is a line-type head having substantially a rectangular parallelepiped shape elongated in the main scanning direction X (the direction perpendicular to the drawing sheet of FIG. 2). The two heads 2 are arranged in the sub-scanning direction Y with a predetermined pitch, and are supported by the housing 1*a* via a frame 3. A joint to which a flexible tube is attached is provided on the upper surface of each head 2. A large number of ejection ports is formed on the lower surface 2*a* of each head 2. A channel is formed inside of each head 2 so that liquid supplied from a corresponding reservoir 42 of the cartridge 40 can reach the ejection ports via the flexible tube and the joint.

The cartridge unit 1*c* includes a tray 35 and one cartridge 40 disposed within the tray 35. The cartridge 40 includes two reservoirs 42 that accommodate black ink and pre-coat liquid, respectively (see FIG. 4). Liquid accommodated in each reservoir 42 of the cartridge 40 is supplied to a corresponding one of the heads 2 via the flexible tube and the joint.

The tray 35 is detachable from the housing 1*a* in the main scanning direction X in a state in which the cartridge 40 is disposed inside. Accordingly, a user of the printer 1 can replace the cartridge 40 in the tray 35 in a state in which the tray 35 is removed from the housing 1*a*.

The configuration of the cartridge 40 will be described with reference to FIGS. 3 through 9B.

Figure 3:
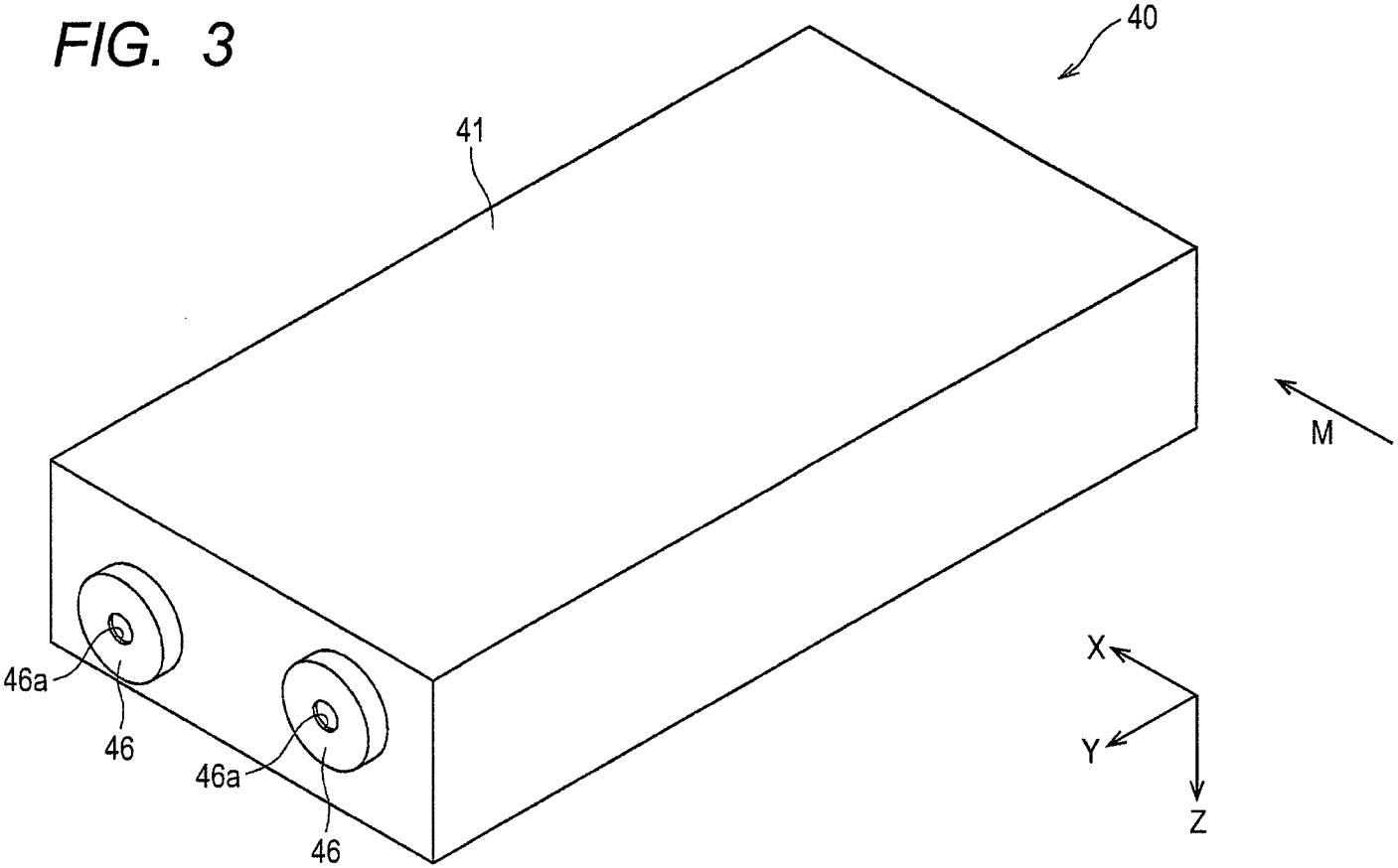
FIG. 3 is a perspective view showing the cartridge.
Figure 4:
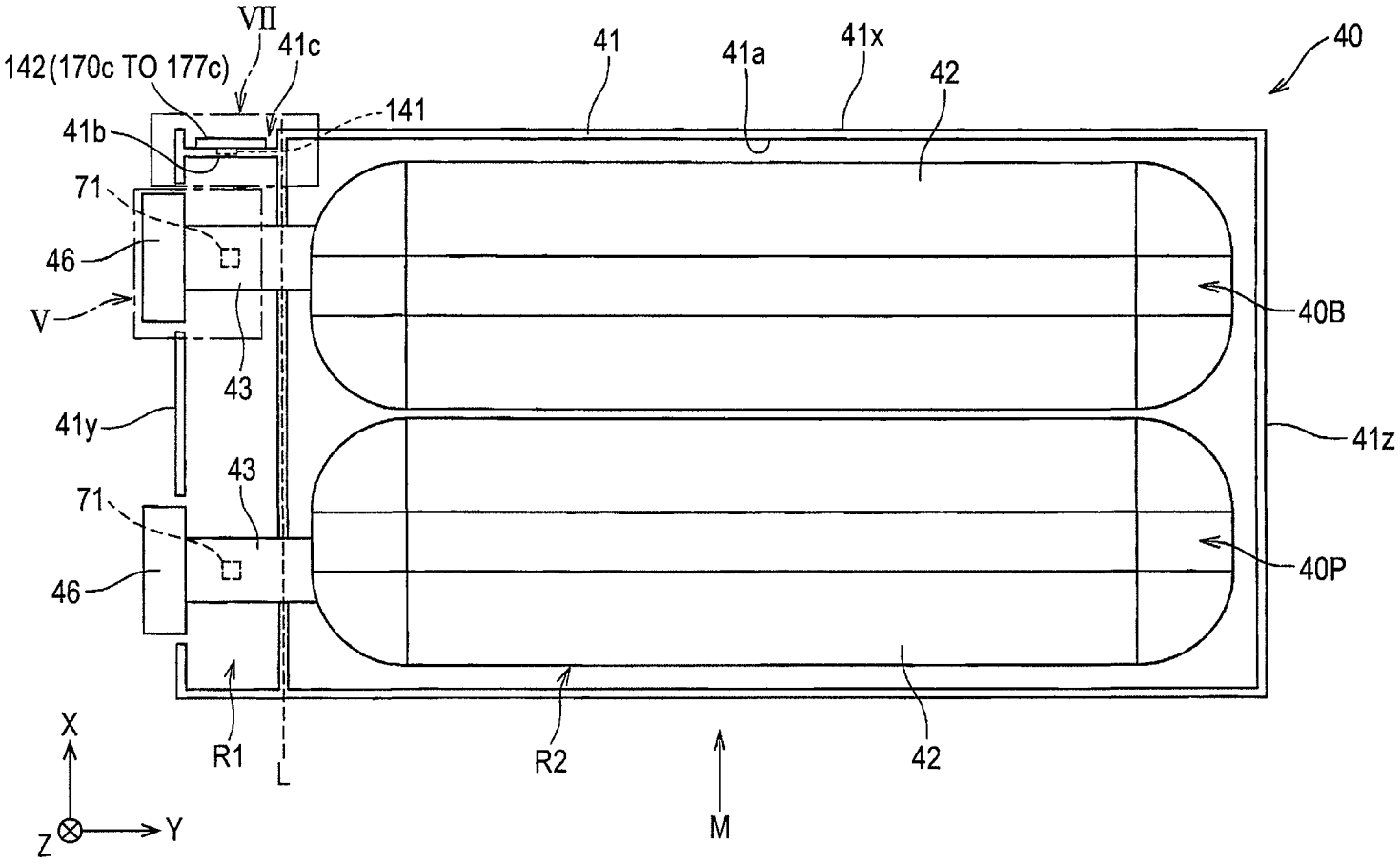
FIG. 4 is a schematic view showing the internal structure of the cartridge.

As shown in FIGS. 3 and 4, the cartridge 40 includes a housing 41, a black ink unit 40B for black ink, a pre-coat liquid unit 40P for pre-coat liquid, the memory 141, and a board 142. Each of the black ink unit 40B and the pre-coat liquid unit 40P includes the reservoir 42, a supply pipe 43, a plug 50, a valve 60, a sensor unit 70, and the like, and has the same configuration (see FIGS. 4, 5A, and 5B).

Figure 9A:
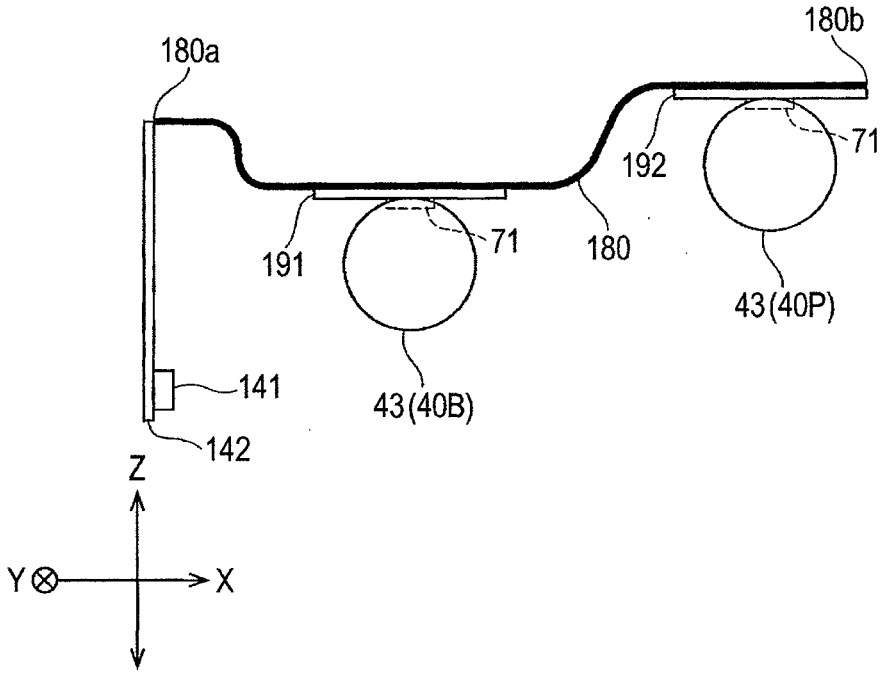

As shown in FIG. 3, the housing 41 has a rectangular parallelepiped shape. As shown in FIG. 4, the inner space of the housing 41 is divided to form two chambers 41*a* and 41*b*. The reservoir 42 of each of the units 40B and 40P is disposed in the chamber 41*a* at the right side in FIG. 4. The supply pipe 43 of each of the units 40B and 40P is disposed in the other chamber 41*b*. As shown in FIGS. 3 and 9A, the units 40B and 40P are arranged at different positions with respect to the vertical direction Z. The pre-coat liquid unit 40P is disposed at a higher position than the black ink unit 40B is.

As shown in FIG. 4, the housing 41 includes a first outer surface 41*x*, a second outer surface 41*y*, and a third outer surface 41*z*.

The first outer surface 41*x* is a surface at a downstream side in a mounting direction (hereinafter, referred to simply as "mounting direction") M, the surface being one of outer surfaces of the housing 41. Here, the mounting direction M is a direction in which the cartridge 40 moves into the space C when the cartridge 40 is mounted into the space C. The first outer surface 41*x* is perpendicular to the mounting direction M. In the present embodiment, the mounting direction M is parallel to the main scanning direction X. A concave section 41*c* is formed at a portion of the first outer surface 41*x* corresponding to the chamber 41*b* in the main scanning direction X.

The second outer surface 41*y* and the third outer surface 41*z* are surfaces parallel to both the mounting direction M and the vertical direction Z. Each of the second outer surface 41*y* and the third outer surface 41*z* connects to the first outer surface 41*x*, and is perpendicular to the first outer surface 41*x*. The second outer surface 41*y* and the third outer surface 41*z* are spaced away from and in confrontation with each other in the sub-scanning direction Y.

The board 142 is disposed on the first outer surface 41*x*. An opening 43*b* (see FIGS. 5A and 5B) of the supply pipe 43 is disposed on the second outer surface 41*y*. The supply pipe 43 is disposed at a position closer to the second outer surface 41*y* than the reservoir 42 is. The reservoir 42 is disposed at a position closer to the third outer surface 41*z* than the supply pipe 43 is.

The reservoir 42 is a pouch that stores liquid. The reservoir 42 of the black ink unit 40B stores black ink, and the reservoir 42 of the pre-coat liquid unit 40P stores pre-coat liquid. An opening section of the reservoir 42 is connected with a base end of the supply pipe 43.

The supply pipe 43 is formed with a supply channel 43*a* (see FIGS. 5A and 5B) for supplying the head 2 with liquid stored in the reservoir 42.

As shown in FIG. 4, a distal end of the supply pipe 43 protrudes outside of the housing 41. The distal end of the supply pipe 43 is provided with the plug 50 made of elastic material such as rubber in a compressed state, so as to close the opening 43*b* of the supply channel 43*a* at the opposite side from the reservoir 42 (see FIGS. 5A and 5B). A cap 46 is provided outside of the distal end of the supply pipe 43 and the plug 50. An opening 46*a* is formed at the center of the cap 46, so that a front surface (the surface at the opposite side from a back surface in confrontation with the valve 60) of the plug 50 is exposed through the opening 46*a*.

Figure 5A:
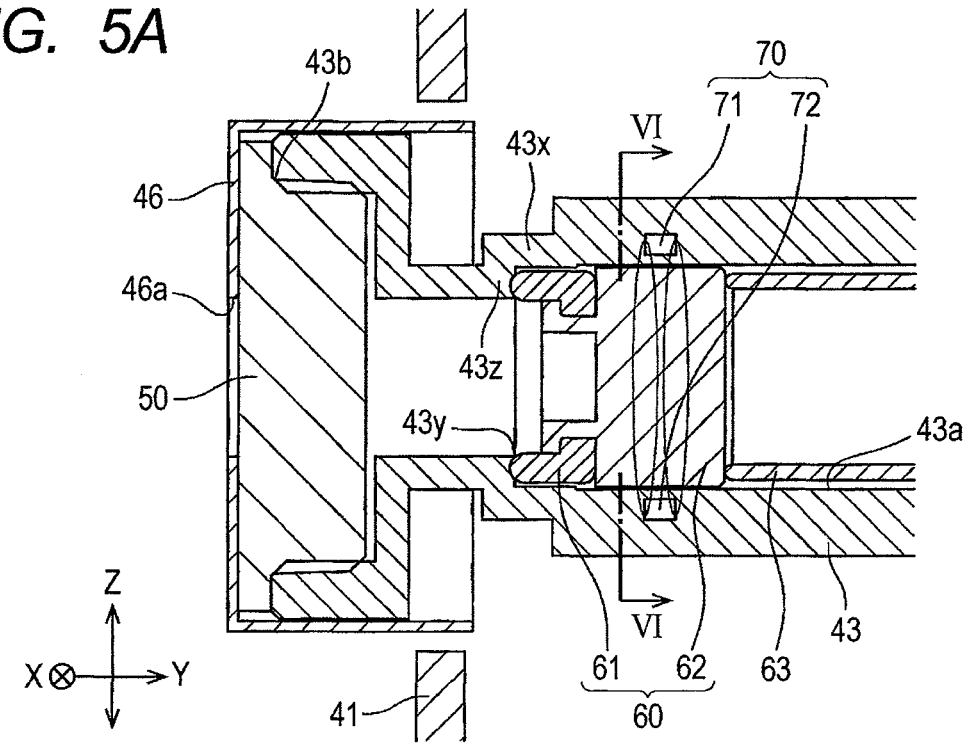
Figure 5B:
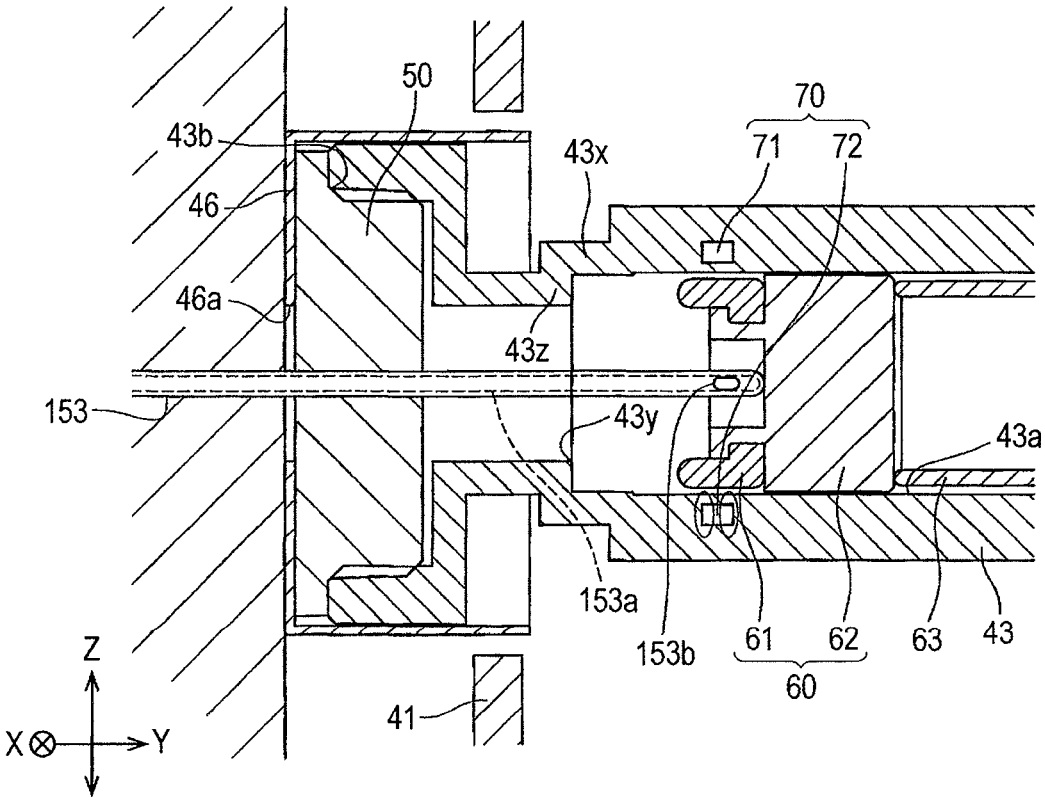

As shown in FIGS. 5A and 5B, the valve 60 is disposed at the supply channel 43*a* and includes an O-ring 61 and a valve main body 62.

Figure 6:
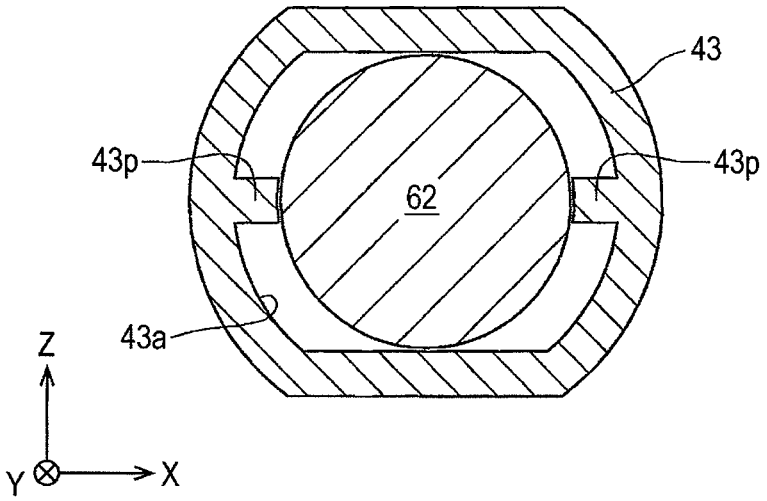
FIG. 6 is a partial cross-sectional view taken along a line VI-VI shown in FIG. 5A.

As shown in FIGS. 5A, 5B, and 6, the valve main body 62 is a magnetic body of a cylindrical shape having an axis in the sub-scanning direction Y.

As shown in FIG. 6, a portion of the supply pipe 43 at which the valve main body 62 is disposed has a cylindrical shape having flat upper and lower walls and having a cross-section elongated in the main scanning direction X, the cross-section being perpendicular to the sub-scanning direction Y. Each of inner surfaces of the supply pipe 43 at both sides in the main scanning direction X is formed with a protrusion 43*p* that protrudes inward in the main scanning direction X. Each protrusion 43*p* extends in the sub-scanning direction Y over a range in which the valve main body 62 is movable. The valve main body 62 is supported by the protrusions 43*p* and the upper and lower walls of the supply pipe 43, and is positioned at the center of the supply channel 43*a* in the cross-section. A channel is secured between the valve main body 62 and the supply pipe 43 at portions except contact portions where the valve main body 62 is in contact with the protrusions 43*p* and the upper and lower walls of the supply pipe 43.

The O-ring 61 is made of elastic material such as rubber, and is fixed to a front surface of the valve main body 62 (the surface that faces the plug 50).

The valve 60 is urged toward an opening 43*y* by a coil spring 63. The coil spring 63 has one end fixed to a base end of the supply pipe 43 and another end in contact with a back surface of the valve main body 62.

As shown in FIG. 5A, when the valve 60 is in a closed position for closing the supply channel 43*a*, the O-ring 61 is in contact with a portion (valve seat) 43*z* that protrudes from one end (the end closer to the opening 43*b*) of a small diameter portion 43*x* of the supply pipe 43 toward the center of the supply pipe 43 in a radial direction, so that the opening 43*y* of one end of the small diameter portion 43*x* is sealed. With this arrangement, fluid communication between the reservoir 42 and the outside via the supply channel 43*a* is blocked. At this time, the O-ring 61 is deformed elastically by urging force of the coil spring 63.

The sensor unit 70 includes the Hall element 71 and a magnet 72. The magnet 72 is for generating a magnetic field. The Hall element 71 is a magnetic sensor that converts inputted magnetic field into an electric signal, thereby generating the electric signal. In the present embodiment, the Hall element 71 generates an electric signal indicative of a voltage value proportional to magnitude of a magnetic field that changes due to movement of the valve main body 62. The Hall element 71 is disposed at a position at which a magnetic field created by the magnet 72 and the valve main body 62 is inputted (see FIG. 5A).

As shown in FIG. 5A, the Hall element 71 and the magnet 72 are fixed to upper and lower walls of the supply pipe 43, respectively, and confront each other in the vertical direction Z.

As shown in FIG. 5A, when the valve 60 is in a closed position, the Hall element 71 and the magnet 72 confront each other with the valve main body 62 interposed therebetween. That is, the valve main body 62 is at a position between the Hall element 71 and the magnet 72. In other words, the valve main body 62 is aligned with a center of the Hall element 71 in the sub-scanning direction Y. At this time, a magnetic field generated by the magnet 72 reaches the Hall element 71 effectively via the valve main body 62. Accordingly, the magnetic field (magnetic flux density) detected by the Hall element 71 is strong, and the Hall element 71 generates a signal indicative of a high voltage value. Here, the valve main body 62 serves as an interacting portion configured to magnetically interact with the Hall element 71 to change the magnetic field (magnetic flux density) at the Hall element 71.

When the valve 60 moves from the closed position shown in FIG. 5A to an open position shown in FIG. 5B where the supply channel 43*a* is opened, the valve main body 62 moves to a position that does not confront the Hall element 71 and the magnet 72 in the vertical direction Z. That is, the valve main body 62 is located at a position that is not between the Hall element 71 and the magnet 72. In other words, the valve main body 62 is not aligned with the center of the Hall element 71 in the sub-scanning direction Y. At this time, the magnetic field (magnetic flux density) detected by the Hall element 71 is weak (small), and the Hall element 71 generates a signal indicative of a low voltage value.

The controller 100 receives a signal generated by the Hall element 71, and determines whether a position of the valve 60 is open or closed based on a voltage value indicated by the signal.

Figure 7:
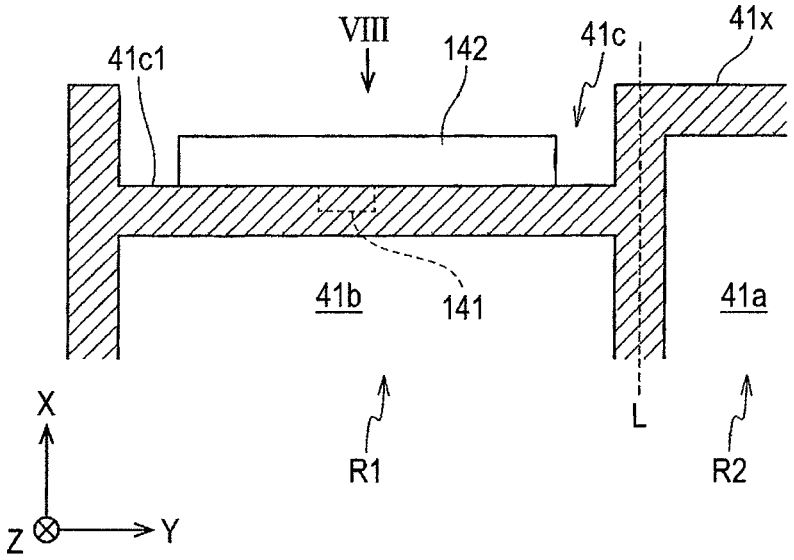
FIG. 7 is a partially enlarged view of a region VII shown in FIG. 4.

As shown in FIG. 7, the board 142 is disposed on a bottom surface 41*c*1 of the concave section 41*c* (an innermost surface of the concave section 41*c*).

The memory 141 is disposed at the back side of the board 142. The memory 141 is an EEPROM or the like, and stores data relating to the cartridge 40. Specifically, the memory 141 preliminarily (that is, at the time of manufacture) stores data such as a liquid amount (an amount of liquid within each reservoir 42 in a brand-new cartridge 40), sensor output values (output values Vmax and Vmin from each Hall element 71; see FIG. 14), and a manufacturing date (date, month, and year on which the cartridge 40 is manufactured). Further, when the cartridge 40 is mounted on the printer 1, the controller 100 can write, in the memory 141, data relating to a used amount of liquid (a used amount of liquid within each reservoir 42, that is, an amount of liquid ejected from each head 2), a number of insertion of hollow needle (a number by which a hollow needle 153 is inserted in the plug 50), a number of recorded sheets (a number of sheets of paper P on which recording is performed with liquid within the cartridge 40), a cumulative usage period (a time period during which the cartridge 40 is mounted on the printer 1, and is the same as a time period during which the hollow needle 153 is inserted in the supply channel 43*a*), and the like. When the cartridge 40 is mounted on the printer 1, the controller 100 can also read data stored in the memory 141.

Figure 8:
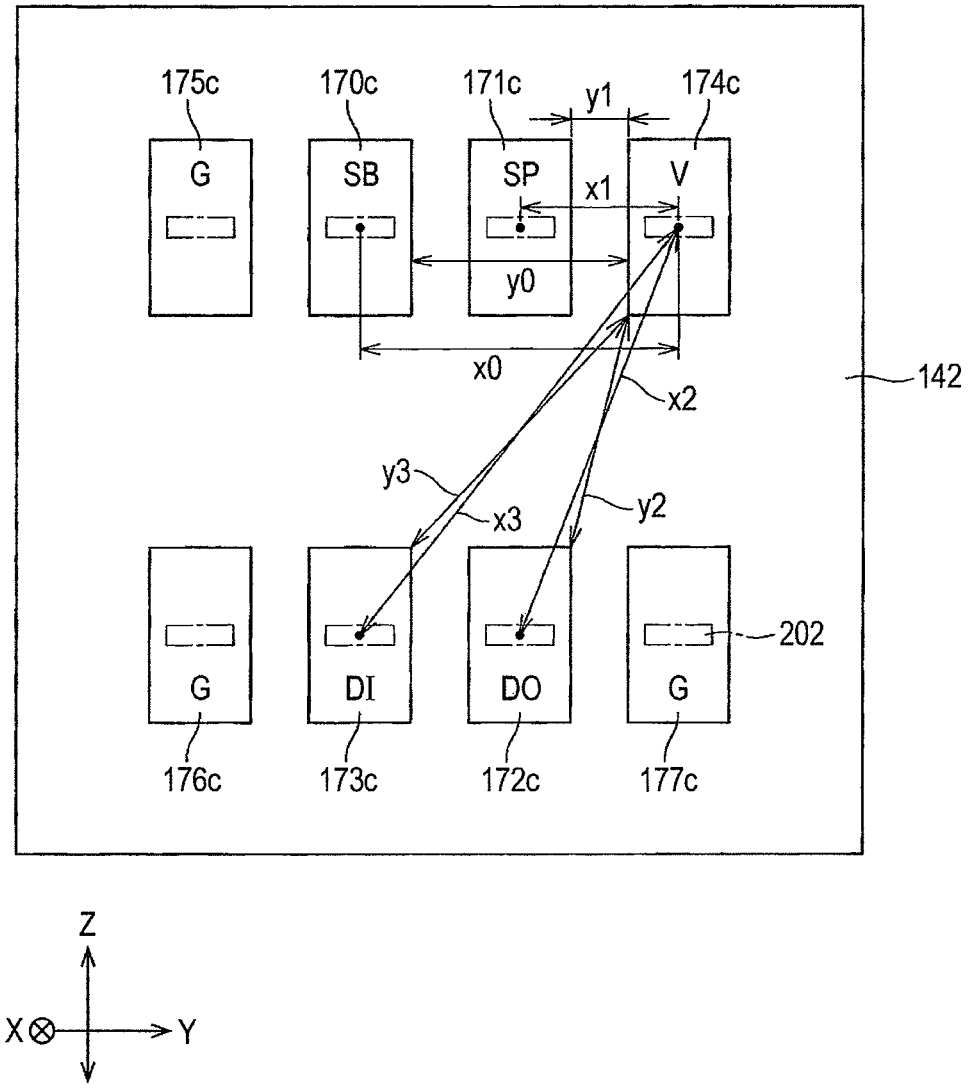
FIG. 8 is a diagram as viewed from a direction VIII shown in FIG. 7, for illustrating a terminal of the cartridge according to the embodiment.

As shown in FIG. 8, eight terminals 170*c* through 177*c* are provided on a surface of the board 142. All of the terminals 170*c* through 177*c* have the same size and shape, and are exposed on an outer surface of the cartridge 40. Each of the terminals 170*c* through 177*c* has a rectangular shape with two short sides parallel to the sub-scanning direction Y and two long sides parallel to the vertical direction Z. The terminals 170*c* through 177*c* are arranged in two rows.

Center-to-center distances x0-x3 between each terminal 170*c*-173*c* and the terminal 174*c* have relationship of x1<x0<x2<x3. Shortest distances y0-y3 between outer edges of each terminal 170*c*-173*c* and the terminal 174*c* have relationship of y1<y0<y2<y3. Here, xn (n=0-3) denotes a center-to-center distance between a terminal 17*nc* and the terminal 174*c*, and yn (n=0-3) denotes a shortest distance between the outer edges of the terminal 17*nc* and the terminal 174*c*.

Figure 11:
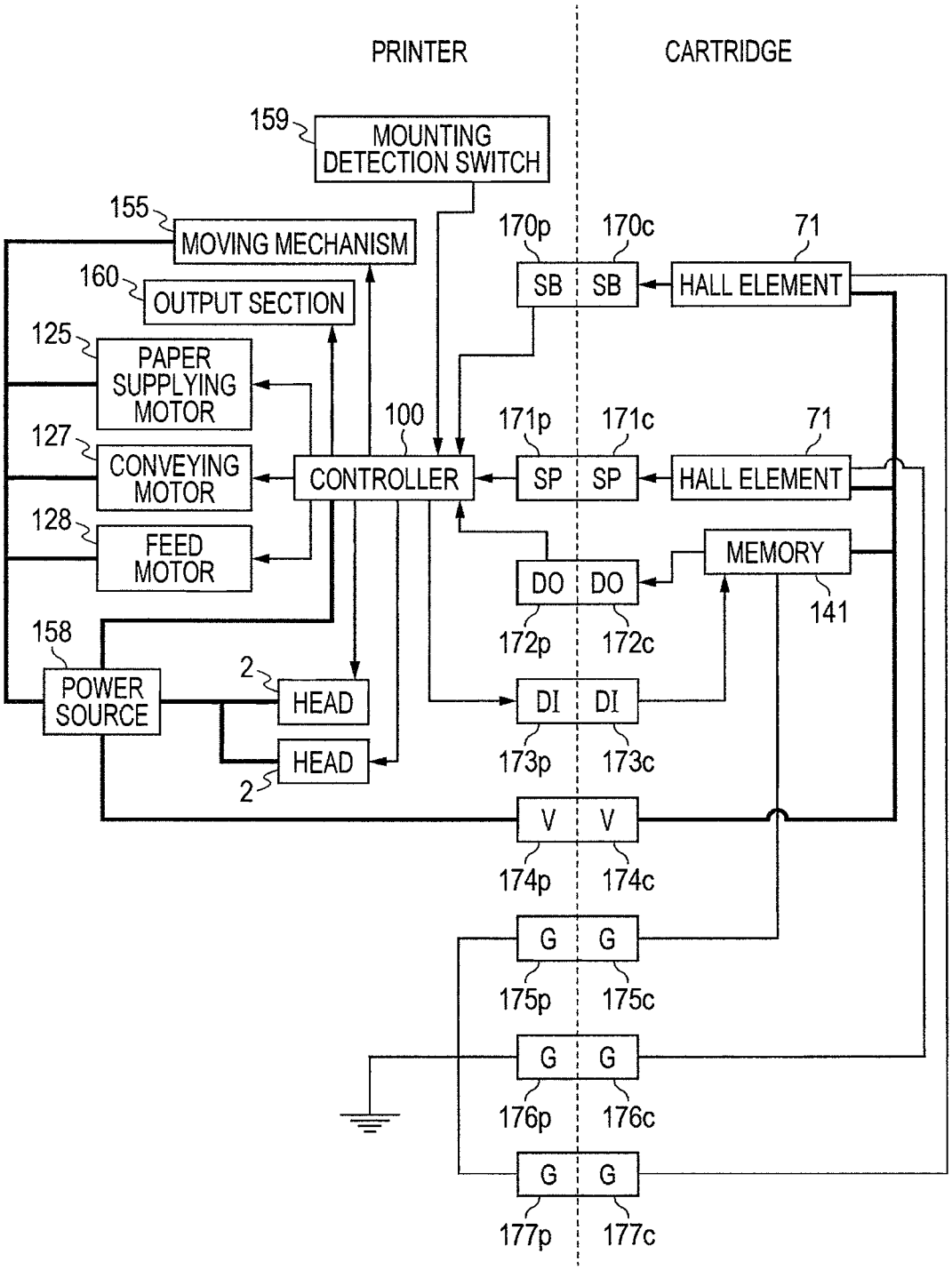
FIG. 11 is a block diagram showing the electrical configuration of the cartridge and the printer.

As shown in FIG. 11, a sensor-signal output terminal (SB) 170*c* is electrically connected with the Hall element 71 of the black ink unit 40B. A sensor-signal output terminal (SP) 171*c* is electrically connected with the Hall element 71 of the pre-coat liquid unit 40P. A data output terminal (DO) 172*c* and a data input terminal (DI) 173*c* are electrically connected with the memory 141. A power input terminal (V) 174*c* is electrically connected with the two Hall elements 71 and the memory 141. Three ground terminals (G) 175*c*, 176*c*, and 177*c* are electrically connected with the memory 141, the Hall element 71 of the pre-coat liquid unit 40P, and the Hall element 71 of the black ink unit 40B, respectively.

As shown in FIG. 9A, the board 142 is connected with one end 180*a* of a flexible cable 180. The flexible cable 180 is an elongated cable extending from the one end 180*a* to another end 180*b* substantially in the main scanning direction X. The flexible cable 180 is accommodated in the chamber 41*b* of the housing 41 (see FIG. 4). On the flexible cable 180, boards 191 and 192 are fixed at positions spaced away from each other between the one end 180*a* and the another end 180*b*. The memory 141 is electrically connected with the one end 180*a* via wiring provided on the board 142. The boards 191 and 192 correspond to the black ink unit 40B and the pre-coat liquid unit 40P, respectively, and are fixed on a top surface of the supply pipe 43 of the corresponding unit. The Hall element 71 is attached to the back side of each of the boards 191 and 192.

Figure 9B:
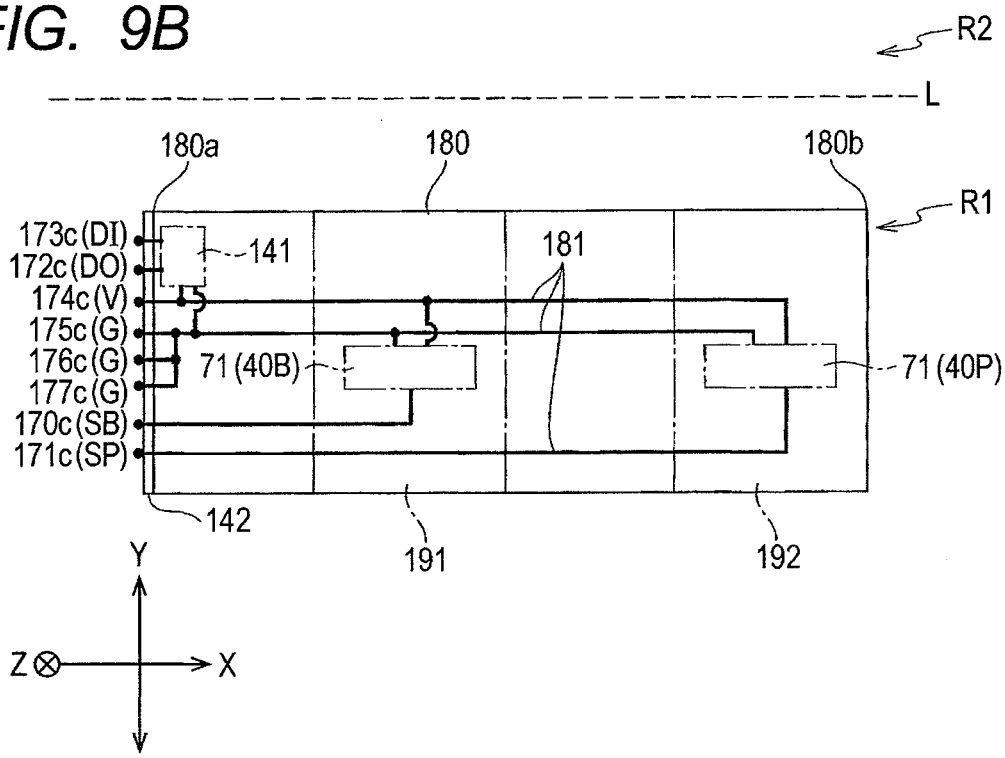

As shown in FIG. 9B, the flexible cable 180 is formed with eight wiring lines 181 that are connected with respective ones of the terminals 170*c* through 177*c*. The wiring line 181 connected with the data input terminal (DI) 173*c* and the wiring line 181 connected with the data output terminal (DO) 172*c* connect to the memory 141. The wiring line 181 connected with the sensor-signal output terminal (SB) 170*c* extends from the one end 180*a* to the board 191 and connects to the Hall element 71 of the black ink unit 40B. The wiring line 181 connected with the sensor-signal output terminal (SP) 171*c* extends from the one end 180*a* via the board 191 to the board 192 and connects to the Hall element 71 of the pre-coat liquid unit 40P. The wiring line 181 connected with the power input terminal (V) 174*c* extends from the one end 180*a* via the board 191 to the board 192, and branches off so as to connect to each of the memory 141, the Hall element 71 of the black ink unit 40B, and the Hall element 71 of the pre-coat liquid unit 40P. The three wiring lines 181 connected with respective ones of the three ground terminals (G) 175*c*, 176*c*, and 177*c* are combined to a single line (that is, two lines of the three lines connect to the other one line) near the one end 180*a*. This single line extends from the one end 180*a* via the board 191 to the board 192, and branches off so as to connect to each of the memory 141, the Hall element 71 of the black ink unit 40B, and the Hall element 71 of the pre-coat liquid unit 40P.

Note that the terminals 170*c* through 177*c* are arranged in a row in FIG. 9B in order to show connection configuration between the terminals 170*c* through 177*c* and elements (the memory 141 and the Hall elements 71) by the wiring lines 181. However, the actual arrangement of the terminals 170*c* through 177*c* is as shown in FIG. 8.

Here, as shown in FIG. 4, the space in the housing 41 can be divided by an imaginary line L parallel to the main scanning direction X, as viewed from the vertical direction Z, into a first region R1 in which the supply pipes 43 are disposed and a second region R2 in which the reservoirs 42 are disposed. The chamber 41*a* in the housing 41 belongs to the second region R2, and the chamber 41*b* belongs to the first region R1.

The Hall elements 71 and the board 142 (the terminals 170*c* through 177*c*) are arranged in the first region R1. The memory 141, the flexible cable 180, the wiring lines 181, the boards 191 and 192 are also arranged in the first region R1 (see FIG. 9B).

Figure 10A:
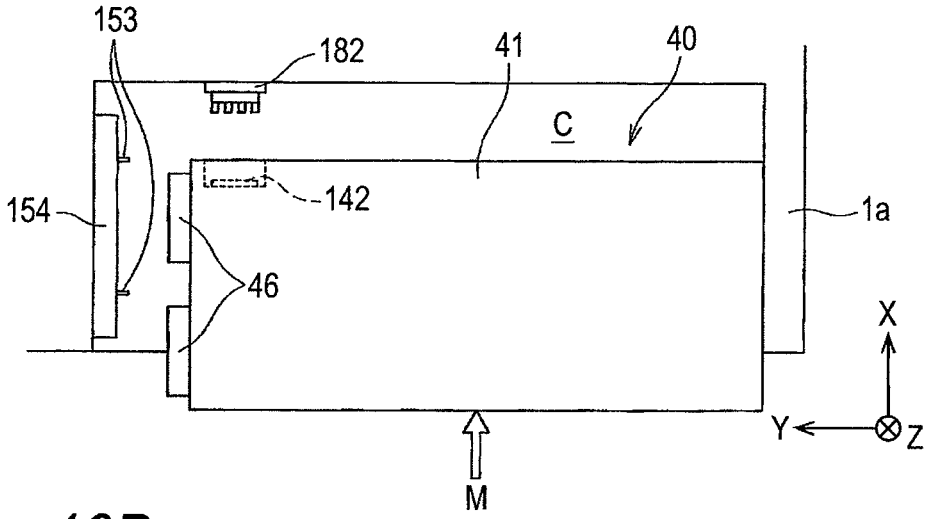
Figure 10B:
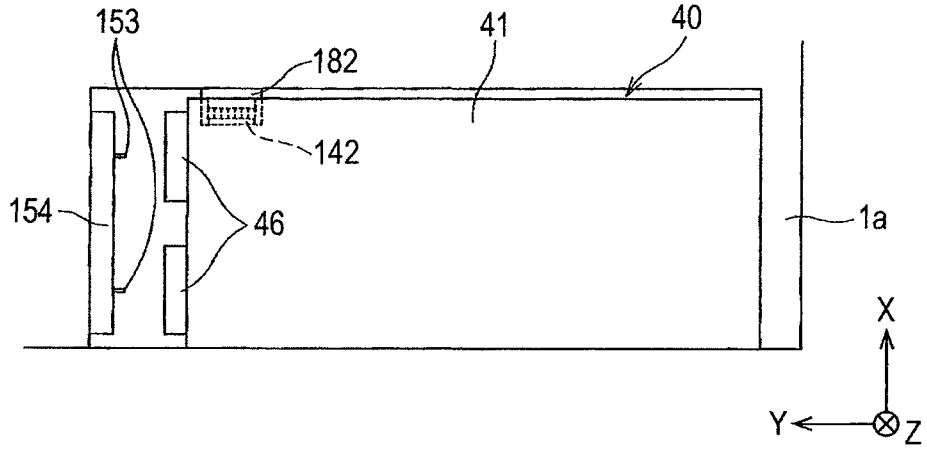
Figure 10C:
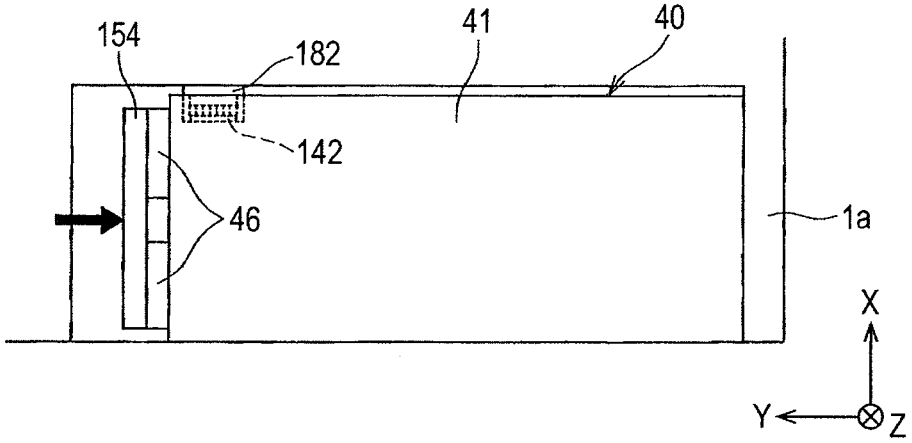

As shown in FIGS. 10A through 10C, a board 182 is provided on a wall surface perpendicular to the mounting direction M (the main scanning direction X), the wall surface being one of wall surfaces defining the space C of the housing 1*a*.

Figure 15:
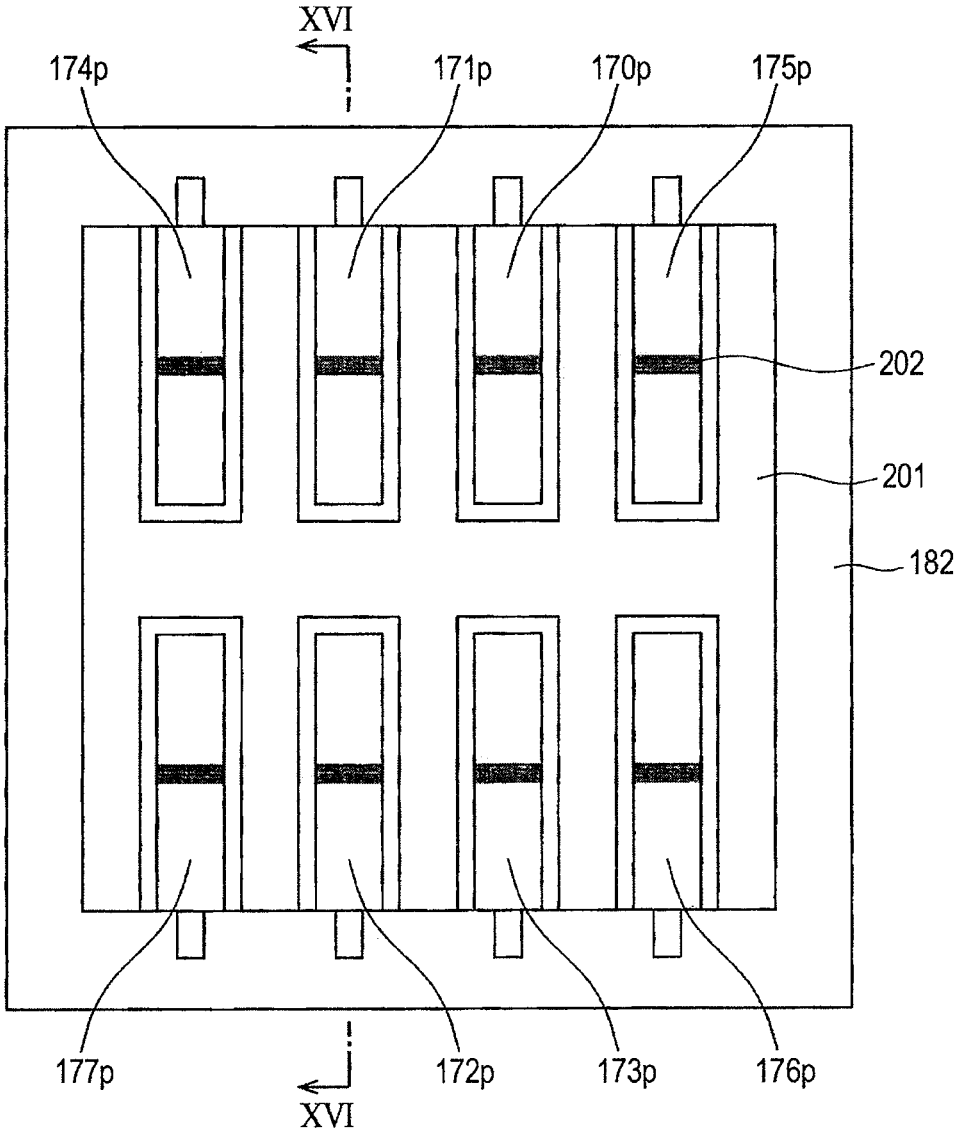
FIG. 15 is a diagram as viewed from a mounting direction shown in FIG. 10, for illustrating a terminal of the printer.
Figure 16:
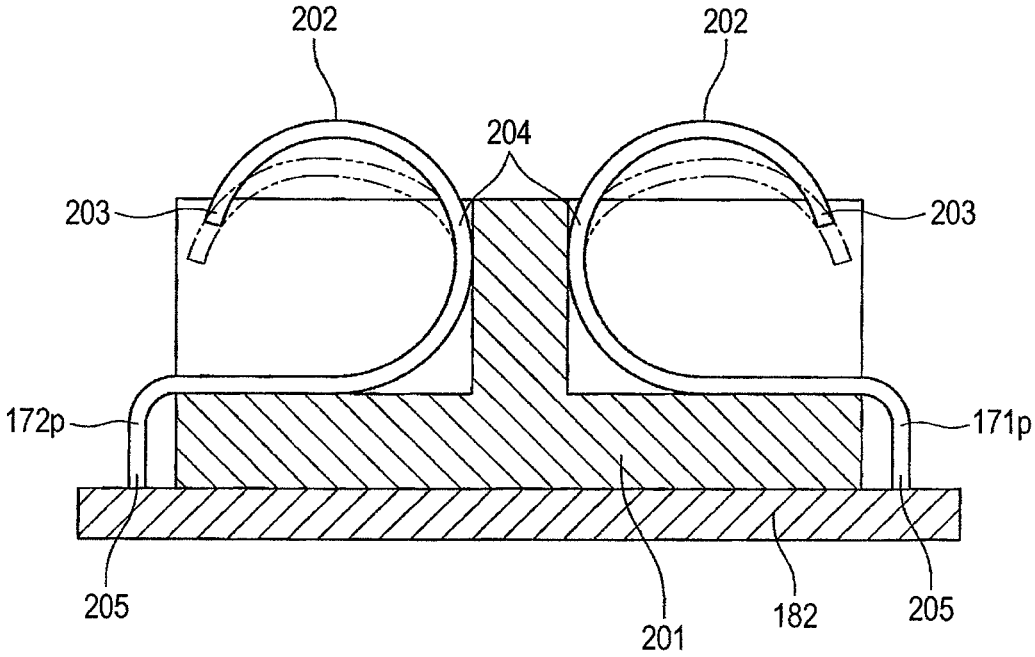
FIG. 16 is a partial cross-sectional view taken along a line XVI-XVI shown in FIG. 15.

The board 182 has substantially the same size as the board 142, and is disposed at a position confronting the board 142 when the cartridge 40 is mounted to a predetermined position in the space C (see FIG. 10B). As shown in FIGS. 15 and 16, a base material 201 is provided on a surface of the board 182. Eight terminals 170*p* through 177*p* corresponding to eight terminals 170*c* through 177*c*, respectively, are provided on the base material 201.

As shown in FIG. 16, each of the terminals 170*p* through 177*p* includes a leaf spring having substantially a C-shape in cross-section. One end 205 of each of the terminals 170*p* through 177*p* is a fixed end that is fixed to the board 182, and is electrically connected with the board 182. Another end 203 of each of the terminals 170*p* through 177*p* is a free end that can bend with a part 204 as a fulcrum. The another end 203 is urged upward in FIG. 16 (that is, the direction approaching the terminals 170*c* through 177*c* of the cartridge 40 mounted at the predetermined position in the space C).

The terminals 170*p* through 177*p* are arranged in a mirror symmetry pattern with the pattern of the terminals 170*c* through 177*c* shown in FIG. 8, so as to make contact with the terminals 170*c* through 177*c*, respectively, when the cartridge 40 is mounted at the predetermined position in the space C.

Each of the terminals 170*p* through 177*p* is arranged so that each top portion 202 makes contact with the center of a corresponding one of the terminals 170*c* through 177*c*.

As shown in FIG. 11, a sensor-signal receiving terminal (SB) 170*p*, a sensor-signal receiving terminal (SP) 171*p*, a data receiving terminal (DO) 172*p*, and a data transmitting terminal (DI) 173*p* are electrically connected with the controller 100. A power output terminal (V) 174*p* is electrically connected with a power source 158. Three ground terminals (G) 175*p*, 176*p*, and 177*p* are connected with ground. The power source 158 is provided in the housing 1*a*.

Next, a process in which the cartridge 40 is mounted to the printer 1 will be described with reference to FIGS. 5A through 16. In FIGS. 10A through 10C, illustration of the tray 35 is omitted. In FIG. 11, power supply lines are indicated by thick lines, and signal lines are indicated by thin lines.

Before the cartridge 40 is mounted to the printer 1, in each of the units 40B and 40P, the hollow needle 153 is not inserted in the plug 50, and the valve 60 is held in a closed position (see FIG. 5A). At this stage, electrical connection between the terminals 170*c* through 177*c* and the terminals 170*p* through 177*p*, respectively, are not achieved. Accordingly, the Hall elements 71 and the memory 141 are not supplied with electrical power, and the controller 100 cannot perform transmission and reception of signals with the Hall elements 71 and the memory 141.

When the cartridge 40 is mounted to the printer 1, the user of the printer 1 moves the tray 35 in the main scanning direction X (the direction indicated by a blanked arrow in FIG. 10A) in a state where the cartridge 40 is placed in the tray 35 (see FIG. 2), thereby inserting the cartridge 40 into the space C of the housing 1*a*. At this time, as shown in FIG. 10B, the cartridge 40 is inserted to a position at which the board 182 is inserted in the concave section 41*c* (see FIG. 7) to make contact with the board 142 so that the terminals 170*c* through 177*c* and the terminals 170*p* through 177*p* are in contact with each other.

At the stage of FIG. 10B, the centers of the terminals 170*c* through 177*c* make contact with the top portions 202 of the terminals 170*p* through 177*p*, respectively, so as to be connected electrically. With this operation, electrical power is supplied from the power source 158 to the Hall elements 71 and the memory 141 via the terminals 174*p* and 174*c*. The controller 100 can then perform reception of signals from the Hall element 71 of the black ink unit 40B via the terminals 170*c* and 170*p*, reception of signals from the Hall element 71 of the pre-coat liquid unit 40P via the terminals 171*c* and 171*p*, reading of data from the memory 141 via the terminals 172*c* and 172*p*, and writing of data to the memory 141 via the terminals 173*c* and 173*p*.

In a process in which the cartridge 40 is mounted to the printer 1, immediately before mounting is completely finished, the centers of the terminals 170*c* through 177*c* make contact with the top portions 202 of the terminals 170*p* through 177*p*. Subsequently, before mounting is completely finished, the terminals 170*p* through 177*p* are pressed by the terminals 170*c* through 177*c* so that the another end 203 bends downward with the part 204 as the fulcrum, thereby shifting from a state shown by solid lines in FIG. 16 to a state shown by double-dot chain lines. The top portions 202 of the terminals 170*p* through 177*p* contact the terminals 170*c* through 177*c* in contact regions (regions surrounded by single-dot chain lines in FIG. 8) including the centers of the terminals 170*c* through 177*c* when mounting is completely finished. From a state immediately before mounting is completely finished to a state when mounting is completely finished, the contact regions of the top portions 202 on the terminals in the upper row (the terminals 175*c*, 170*c*, 171*c*, and 174*c*) slide upward gradually from positions slightly below the regions surrounded by single-dot chain lines in FIG. 8, whereas the contact regions of the top portions 202 on the terminals in the lower row (the terminals 176*c*, 173*c*, 172*c*, and 177*c*) slide downward gradually from positions slightly above the regions surrounded by single-dot chain lines in FIG. 8.

A support body 154 is disposed on a wall surface perpendicular to the sub-scanning direction Y and confronting the two caps 46 when the cartridge 40 is mounted to the predetermined position in the space C, the wall surface being one of wall surfaces defining the space C of the housing 1*a*. The support body 154 supports the two hollow needle 153 and is movable in the sub-scanning direction Y relative to the housing 1*a*. The two hollow needles 153 correspond to the head 2 that ejects black ink and the head 2 that ejects pre-coat liquid, respectively, and are in fluid communication with the flexible tube attached to the joint of the corresponding head 2.

At the stage of FIG. 10B, the cartridge 40 is separated from the hollow needles 153, and each reservoir 42 is not in fluid communication with the channel of the corresponding head 2.

The printer 1 includes a mounting detection switch 159 (see FIG. 11) that detects that the cartridge 40 is mounted at the predetermined position in the space C. The mounting detection switch 159 has a convex section (not shown) provided on a wall surface perpendicular to the mounting direction M, the wall surface being one of the wall surfaces defining the space C of the housing 1*a*. The convex section is provided near the board 182, for example. The convex section is in a protruding state before the cartridge 40 is mounted to the space C and, when the cartridge 40 is inserted in the space C to reach a position shown in FIG. 10B, retracts in the wall surface by being pressed by the housing 41 of the cartridge 40. The mounting detection switch 159 outputs an OFF signal when the convex section is in a protruding state, and outputs an ON signal when the convex section is retracted in the wall surface.

Figure 13:
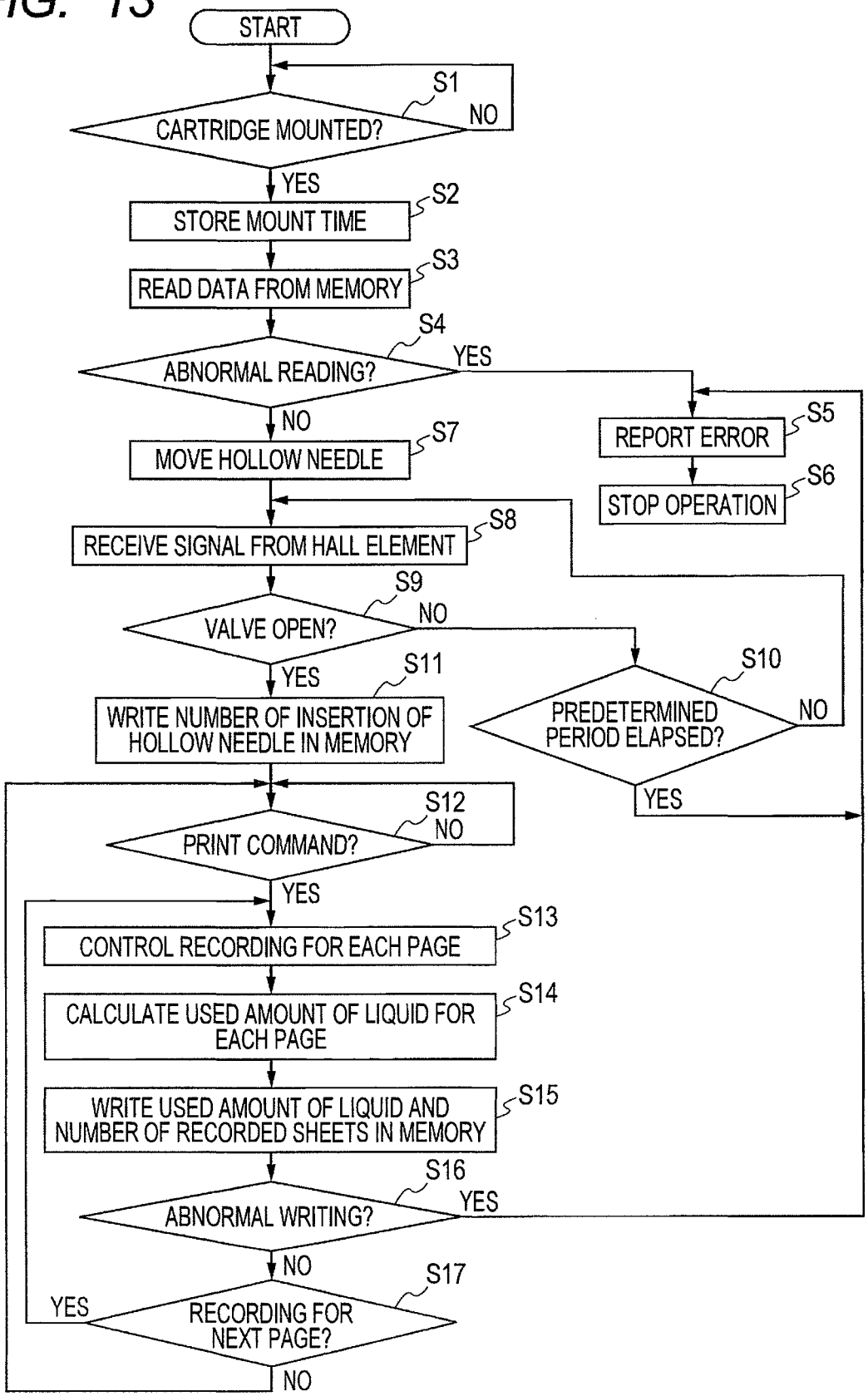
FIG. 13 is a flowchart showing controls performed by the controller of the printer when the cartridge is mounted on the printer.

The controller 100 determines whether the cartridge 40 is mounted at the predetermined position in the space C, based on a signal received from the mounting detection switch 159 (S1 in FIG. 13). If the controller 100 determines that the cartridge 40 is mounted at the predetermined position in the space C by reception of an ON signal from the mounting detection switch 159 (S1: YES), the controller 100 stores time at that time (mount time) in the RAM of the controller 100 (S2). Subsequent to S2, the controller 100 reads data stored in the memory 141 of the cartridge 40 (data relating to the liquid amount, the sensor output value, the manufacturing date, the used amount of liquid, the number of insertion of hollow needle, the number of recorded sheets, the cumulative usage period, and the like) (S3).

Subsequent to S3, the controller 100 determines whether reading in S3 is abnormal (S4). If reading is not performed normally in S3, the controller 100 determines that reading in S3 is abnormal (S4: YES) and controls an output section 160 (see FIG. 11) such as a display, a speaker, etc. of the printer 1 to report an error (S5). Subsequent to S5, the controller 100 stops operations of each section of the printer 1 (S6).

If reading is abnormal, it is presumed that the memory 141 is damaged by short circuit between the terminal 172*c* and the terminal 174*c*, or that a failure occurs with communication function of the controller 100 by short circuit between the terminal 173*c* and the terminal 174*c*.

If reading is performed normally in S3, the controller 100 determines that reading is not abnormal (S4: NO) and controls a moving mechanism 155 (see FIG. 11) to move the support body 154 together with the two hollow needles 153 supported by the support body 154 in the sub-scanning direction Y (the direction indicated by a filled arrow in FIG. 10C) (S7).

With movement of the hollow needle 153 in S7, as shown in FIG. 5B, in each of the units 40B and 40P, first, the hollow needle 153 penetrates a substantial center of the plug 50 via the opening 46*a* in the sub-scanning direction Y.

At this time, an opening 153*b* formed at the distal end of the hollow needle 153 is located in the supply channel 43*a*, so that a channel 153*a* in the hollow needle 153 and the supply channel 43*a* are in fluid communication with each other via the opening 153*b*. Although a hole is formed in the plug 50 by the hollow needle 153 at this time, a portion of the plug 50 around the hole closely contacts the outer circumferential surface of the hollow needle 153 by elasticity. This suppresses liquid leakage from between the hole in the plug 50 and the hollow needle 153.

Subsequently, the distal end of the hollow needle 153 abuts the valve main body 62. Then, further penetration of the hollow needle 153 into the supply channel 43*a* causes the valve main body 62 to move together with the O-ring 61 and causes the O-ring 61 to separate from the valve seat 43*z* (see FIG. 5B). At this time, the position of the valve 60 changes from a closed position to an open position.

When the valve 60 is in the open position, fluid communication between the reservoir 42 and the outside is allowed via the supply channel 43*a*. That is, as shown in FIG. 5B, when the plug 50 is penetrated by the hollow needle 153 and the valve 60 is in the open position, the reservoir 42 is in fluid communication with the channel of the head 2 via the supply channel 43*a*, the channel 153*a*, and the like.

Subsequent to S7, the controller 100 receives a signal from the Hall element 71 of each of the units 40B and 40P (S8). Subsequent to S8, the controller 100 determines whether the valve 60 is disposed at the open position in each of the units 40B and 40P (that is, whether fluid communication is formed between the reservoir 42 and the head 2 so that liquid can be supplied from the reservoir 42 to the head 2 via the hollow needle 153), based on the output values Vmax and Vmin read from the memory 141 in S3 and on the signal received in S8 (S9). In the present embodiment, determination in S9 is performed as described below.

Figure 14:
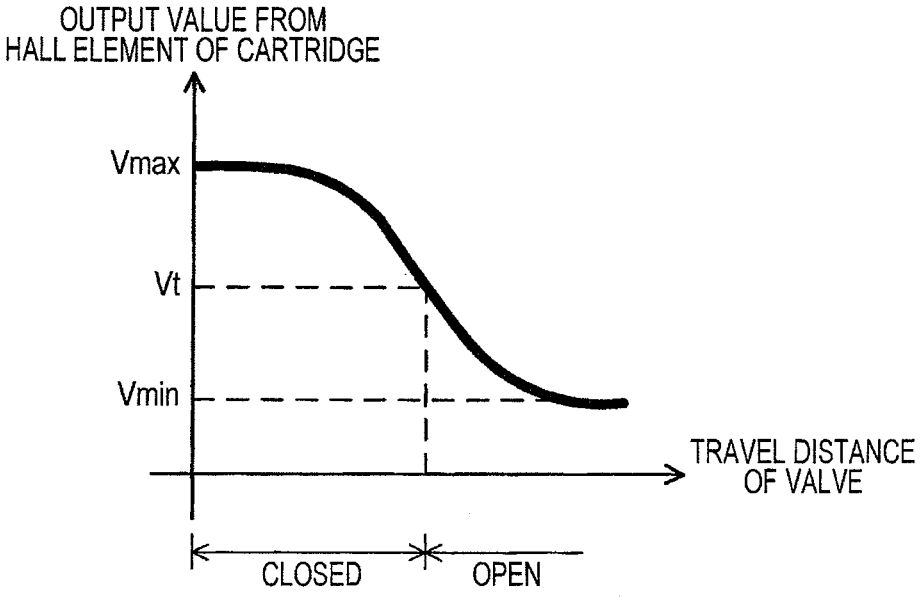
FIG. 14 is a graph showing relationship between travel distances of the valve and output values from a Hall element of the cartridge.

FIG. 14 shows relationship between travel distances of the valve 60 and output values from the Hall element 71. The horizontal axis indicates the travel distance of the valve 60 from the closed position shown in FIG. 5A in a direction away from the plug 50 in the sub-scanning direction Y. The output values Vmax and Vmin are output values from the Hall element 71 when a predetermined driving voltage is applied to the Hall element 71 in a state where the valve 60 is in the closed position and in the open position, respectively. The controller 100 determines that the valve 60 is in the open position if the output value from the Hall element 71 received in S8 is less than or equal to a threshold value Vt (for example, Vt=(Vmax+Vmin)/2) calculated based on the output values Vmax and Vmin read in S3, and determines that the valve 60 is in the closed position if the output value from the Hall element 71 is greater than the threshold value Vt. In the present embodiment, the output values Vmax and Vmin are measured during a manufacturing process of each cartridge 40 and are stored in the memory 141.

If a predetermined period elapses while the valve 60 of each of the units 40B and 40P is not disposed in the open position (S10: YES), the controller 100 reports an error (S5) and stops operations of each section of the printer 1 (S6).

In this case, it is presumed that the Hall element 71 of the black ink unit 40B is damaged by short circuit between the terminal 170*c* and the terminal 174*c*, that the Hall element 71 of the pre-coat liquid unit 40P is damaged by short circuit between the terminal 171*c* and the terminal 174*c*, that a failure occurs with communication function of the controller 100 by short circuit between the terminal 173*c* and the terminal 174*c*, or that a failure occurs with the plug 50, the valve 60, the hollow needle 153, and the moving mechanism 155 of the printer 1, etc.

If the controller 100 determines that the valve 60 of each of the units 40B and 40P is disposed in the open position (S9: YES), the controller 100 writes, in the memory 141, data indicative of a value obtained by adding one to the number of insertion of hollow needle read in S3 (S11). Subsequent to S11, the controller 100 determines whether a print command from an external device has been received (S12).

If a print command is received (S12: YES), the controller 100 controls driving of a paper supplying motor 125, a conveying motor 127, the feed motor 128, the head 2, and the like to perform recording for each page of paper P (S13). Subsequent to S13, the controller 100 calculates the used amount of liquid for each page of paper P (that is, the amount of each liquid of black ink and pre-coat liquid ejected for one page of the paper P that is recorded this time) (S14).

Subsequent to S14, the controller 100 writes, in the memory 141, data indicative of the used amount of each liquid (the amount of liquid in each reservoir 42 that has been used since the cartridge 40 is a brand-new cartridge, that is, a value obtained by adding the used amount of liquid for each page calculated in S14 to the used amount of liquid read in S3) and the number of recorded sheets (the number of sheets of paper P on which recording has been performed with the cartridge 40 since the cartridge 40 is a brand-new cartridge, that is, a value obtained by adding one to the number of recorded sheets read in S3) (S15).

Subsequent to S15, the controller 100 determines whether writing in S15 is abnormal (S16). If writing is not performed normally in S15, the controller 100 determines that writing in S15 is abnormal (S16: YES), reports an error (S5), and stops operations of each section of the printer 1 (S6).

If writing is abnormal, it is presumed that the memory 141 is damaged by short circuit between the terminal 172*c* and the terminal 174*c*, or that a failure occurs with communication function of the controller 100 by short circuit between the terminal 173*c* and the terminal 174*c*.

If writing is performed normally in S15, the controller 100 determines that writing is not abnormal (S16: NO), and determines whether there are recording data for the next page, based on image data included in the print command received in S12 (S17).

If there are recording data for the next page (S17: YES), the controller 100 returns to S13 and repeats the above-described series of steps S13 through S16. On the other hand, if there are no recording data for the next page (S17: NO), the controller 100 returns to S12 and waits until a print command is received again.

Note that the printer 1 includes a lock mechanism (not shown) for locking the cartridge 40. If the controller 100 determines that the cartridge 40 is mounted at the predetermined position in the space C (S1: YES), the controller 100 drives the lock mechanism concurrently with the process in S2, for example, to lock the cartridge 40 together with the tray 35 at the predetermined position.

In order to dismount the cartridge 40 from the printer 1, the user of the printer 1 presses a lock release button. If the controller 100 detects pressing of the lock release button, the controller 100 first controls the moving mechanism 155 (see FIG. 11) to move the support body 154 in the direction opposite from the filled arrow in FIG. 10C so that the support body 154 returns from the position of FIG. 10C to the position of FIG. 10B. At this time, in each of the units 40B and 40P, as the hollow needle 153 moves in the leftward direction in FIG. 5B, urging force of the coil spring 63 causes the valve 60 to move in the leftward direction in FIG. 5B to make contact with the valve seat 43*z*. With this operation, the position of the valve 60 shifts from the open position to the closed position. The controller 100 determines that the valve 60 is in the closed position when the output value from the Hall element 71 exceeds the threshold value Vt in each of the units 40B and 40P and, based on that time (dismount time) and mount time stored in S2, calculates the cumulative usage period (a time period from the mount time until the dismount time). The controller 100 writes, in the memory 141, data indicative of a value obtained by adding the cumulative usage period read in S3 to the calculated cumulative usage period (that is, the value is the cumulative usage period during which the cartridge 40 is mounted on the printer 1 since the cartridge 40 is a brand-new cartridge). Subsequently, the hollow needle 153 is pulled out of the plug 50. At this time, a hole formed in the plug 50 by the hollow needle 153 becomes small to an extent that liquid leakage is suppressed, due to elasticity of a portion of the plug 50 around the hole.

Subsequently, the controller 100 drives the lock mechanism to unlock the cartridge 40. In this state, the user can pull the tray 35 out of the space C. When the tray 35 is pulled out of the space C, the board 142 separates from the board 182. Thus, electrical connections between the terminals 170*c* through 177*c* and the terminals 170*p* through 177*p*, respectively, are disconnected, which stops power supply to the Hall elements 71 and the memory 141 and which prevents the controller 100 from performing transmission and reception of signals with the Hall elements 71 and the memory 141.

Note that the controller 100 displays a value obtained by subtracting the used amount of liquid written in the memory 141 in S15 from the liquid amount read in S3, as the remaining amount of each liquid, on the display of the printer 1.

Figure 12:
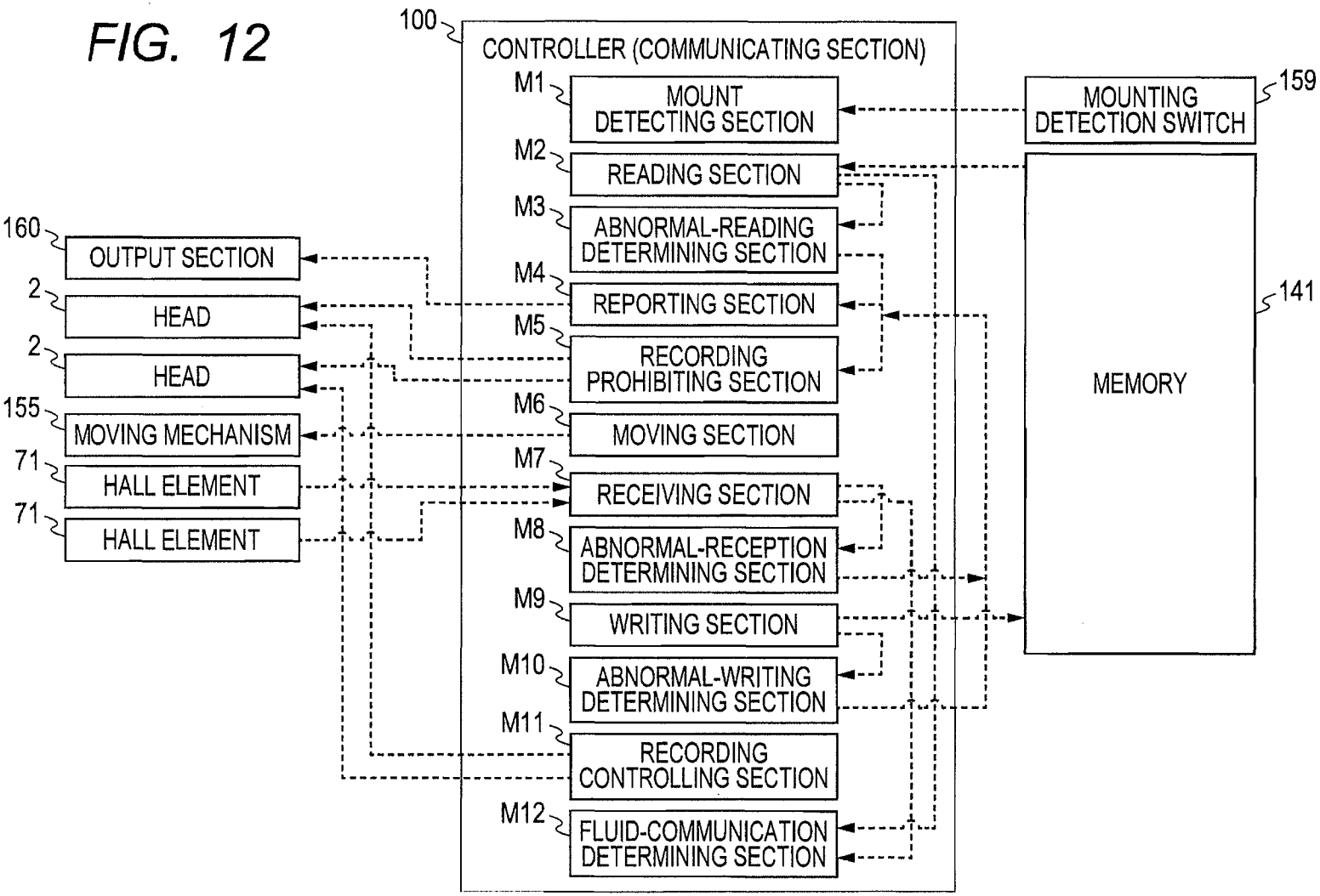
FIG. 12 is a functional block diagram showing each section constructed by a controller of the printer.

As shown in FIG. 12, the controller 100 serves as a communication section that communicates with the cartridge 40 mounted in the space C, and also serves as each section corresponding to processes in FIG. 13.

In the present embodiment, a mount detecting section M1 corresponds to S1, a reading section M2 corresponds to S3, an abnormal-reading determining section M3 corresponds to S4, a reporting section M4 corresponds to S5, a recording prohibiting section M5 corresponds to S6, a moving section M6 corresponds to S7, a receiving section M7 corresponds to S8, an abnormal-reception determining section M8 corresponds to S9 and S10, a writing section M9 corresponds to S11 and S15, an abnormal-writing determining section M10 corresponds to S16, a recording controlling section M11 corresponds to S13, and a fluid-communication determining section M12 corresponds to S9.

As described above, according to the present embodiment, it is possible to determine whether the hollow needle 153 is inserted in the supply channel 43*a* appropriately, based on signals from the Hall element 71. Accordingly, fluid communication between the reservoir 42 and the head 2 can be detected appropriately and correctly.

In the housing 41 of the cartridge 40, the first region R1 tends to be a dead space. However, because the Hall elements 71 and the sensor-signal output terminals 170*c* and 171*c* are arranged in the first region R1, the space within the housing 41 can be utilized efficiently. In addition, the length of the wiring line 181 connecting the Hall elements 71 and the sensor-signal output terminals 170*c* and 171*c* can be shortened.

The first outer surface 41*x*, on which the terminals 170*c* through 177*c* are disposed, and the second outer surface 41*y*, on which the openings 43*b* are disposed, intersect each other. With this configuration, a contact operation between the terminals 170*c* through 177*c* and the terminals 170*p* through 177*p*, respectively, (see FIG. 10B) and an inserting operation of the hollow needle 153 into the supply channel 43*a* through the opening 43*b* (see FIG. 10C) can be performed independently from each other.

The Hall element 71 detects the valve 60 that moves by being pressed by the hollow needle 153. Thus, insertion of the hollow needle 153 into the supply channel 43*a* can be detected appropriately by using the valve 60.

As shown in FIGS. 4, 5A, and 5B, the supply pipe 43 extends linearly in the sub-scanning direction Y. Thus, the configuration of the cartridge 40 can be simplified.

As shown in FIG. 4, the Hall elements 71 and the sensor-signal output terminals 170*c* and 171*c* are arranged in the main scanning direction X. Thus, the length of the wiring lines 181 connecting the Hall elements 71 and the sensor-signal output terminals 170*c* and 171*c* can be shortened reliably. Further, bending of the wiring line 181 can be suppressed.

As shown in FIG. 9B, as viewed from the vertical direction Z, the wiring lines 181 are arranged in the first region R1 where the Hall elements 71 and the sensor-signal output terminals 170*c* and 171*c* are arranged. Thus, the length of the wiring lines 181 can be shortened more reliably.

As shown in FIG. 7, the board 142 on which the terminals 170*c* through 177*c* are provided is disposed on the bottom surface 41*c*1 of the concave section 41*c* formed in the first outer surface 41*x*. Further, when the cartridge 40 is mounted to the space C, the first outer surface 41*x* is a surface of the housing 41 at the downstream side in the mounting direction M. When the cartridge 40 is mounted to the space C, the concave section 41*c* guides the board 182. With this configuration, both of a mounting operation of the cartridge 40 to the space C and a contacting operation of the terminals 170*c* through 177*c* and the terminals 170*p* through 177*p* can be performed reliably at substantially the same timing (see FIG. 10B).

The two boards 191 and 192 are connected with each other via the single flexible cable 180. Thus, the number of terminals and the wiring lines 181 can be reduced and the configuration can be simplified, compared with a case in which, for example, a flexible cable is provided for each of the boards 191 and 192 (that is, a cable connecting the board 142 and the board 191, and a cable connecting the board 142 and the board 192).

As shown in FIG. 9B, the Hall elements 71 of the units 40B and 40P share the power input terminal (V) 174*c* and the ground terminals (G) 175*c*, 176*c*, and 177*c*. Thus, it is not necessary to provide the power input terminal (V) 174*c* and the ground terminals (G) 175*c*, 176*c*, and 177*c* for each Hall element 71. Accordingly, the number of terminals and the wiring lines 181 can be reduced and the configuration can be simplified.

Further, as shown in FIG. 9B, the wiring line 181 (the wiring line shown at the lowermost side in FIG. 9B) corresponding to the Hall element 71 (the Hall element 71 of the pre-coat liquid unit 40P) attached to the board 192 closer to the another end 180*b* (among the two boards 191 and 192) extends to the board 192 via the board 191 which is closer to the one end 180*a* than the board 192 is. Hence, the configuration of the wiring lines 181 can be simplified more efficiently.

While the invention has been described in detail with reference to the above aspects thereof, it would be apparent to those skilled in the art that various changes and modifications may be made therein without departing from the scope of the claims.

<Modifications Regarding Terminals of the Cartridge>

The terminals may be provided separately on a plurality of boards.

The shapes of the terminals are not limited to rectangular shapes but may be any shape (for example, the shapes may be circular shapes or the like).

Distances between the terminals need not be equal, and distance relationship between the terminals may be changed arbitrarily. Further, the arrangement and sizes of the terminals may be changed arbitrarily. For example, in FIG. 8, the positions of the data input terminal 173*c* and the data output terminal 172*c* may be switched. The positions of the sensor-signal output terminals 170*c* and 171*c* may be switched. The power input terminal 174*c* may be arranged at the right-lower end, the left-upper end, the left-lower end, or the like, not the right-upper end, or may be arranged at a position other than an end of a row. Further, the number of rows in which terminals are arranged, the number of terminals included in each row, and the like are also arbitrary. Additionally, terminals may be arranged in a circular shape, or in a random shape, not in rows.

The surface on which terminals are arranged (the first outer surface) is not limited to a surface at the downstream side in the mounting direction of the cartridge onto the mounting section, but may be a surface at the upstream side in the mounting direction. Further, the first outer surface is not limited to a surface perpendicular to the mounting direction, but may be a surface parallel to the mounting direction, for example.

The sensor-signal output terminal need not be disposed on the bottom surface of the concave section formed in the first outer surface.

The number of the sensor-signal output terminals may be changed in accordance with the number of sensors.

The number of ground terminals is arbitrary, and a ground terminal may be omitted.

It is sufficient that the power input terminal is electrically connected with at least one of a sensor (the Hall element 71, for example) and a storage section (the memory 141, for example) so that the power input terminal can input power to the at least one of the sensor and the storage section (for example, power may be inputted into the storage section via the data input terminal). Further, two or more power input terminals may be provided, or a power input terminal may be omitted.

A data output terminal and a data input terminal may be omitted.

<Modifications Regarding Terminals of the Apparatus Main Unit>

The terminals of the apparatus main unit may have the same size as or a larger size than the terminals of the cartridge.

The number or arrangement of the terminals of the apparatus main unit may partially correspond to the terminals of the cartridge. For example, in a case where the terminals of the cartridge are arranged in two rows each including three terminals, the terminals of the apparatus main unit may be arranged in two rows each including four terminals, as shown in FIG. 8. In this case, the terminals of the apparatus main unit include terminals that do not contact the terminals of the cartridge.

Similarly, the number or arrangement of the terminals of the cartridge may partially correspond to the terminals of the apparatus main unit. For example, the terminals of the cartridge may include terminals that do not contact the terminals of the apparatus main unit.

The terminals of the apparatus main unit may be terminals of a leaf-spring type (terminals urged by leaf springs in a direction toward the terminals of the cartridge) or may be other than a leaf-spring type.

The terminals of the apparatus main unit and the terminals of the cartridge may be so designed that positions other than centers of the terminals serve as contact portions.

<Modifications Regarding Other Configuration of the Cartridge>

The sensor is not limited to a magnetic sensor such as the Hall element 71, but may be sensors of various types (for example, a reflective-type optical sensor, a transmission-type optical sensor, a mechanical sensor that detects an existence of an object based on a contact with the object, or the like).

In the above-described embodiment, the sensor detects a movable member that moves in a channel by being pressed by a hollow member. However, the sensor may detect a position of the hollow member in the channel directly or indirectly. For example, in the above-described embodiment, the Hall elements 71 (as the sensor) are used for detecting whether the valve 60 is open or closed. However, if the hollow member is inserted into the channel substantially concurrently with mounting of the liquid cartridge onto the mounting section, a mounting detection sensor may be used for detecting that the liquid cartridge has been mounted on the mounting section. As the mounting detection sensor, the mounting detection switch 159 in the above-described embodiment, an optical sensor, or the like may be used.

The number of sensor(s) provided on the cartridge may be one or more.

It is sufficient that the second and third outer surfaces intersect the first outer surface, and the second and third outer surfaces need not be perpendicular to the first outer surface. Further, the second and third outer surfaces need not be parallel to each other.

The direction in which the channel extends is not limited to the second direction. Further, the channel is not limited to a linear shape, but may be a shape having a bent portion such as L-shape, for example.

The configurations of the wiring lines and the flexible cable are arbitrary. For example, it is not necessary that two or more sensors be connected with each other by a single flexible cable, but a flexible cable may be provided individually for each sensor. A portion of the wiring line may be disposed outside the first region.

In the above-described embodiment, the cartridge stores two kinds of liquid (black ink and pre-coat liquid). However, the cartridge may store only one kind of liquid.

Data stored in the storage section are not limited to particular kinds of data. As data relating signals generated by the sensor, the amount of liquid within the liquid storing section, and the like, the storage section need not store output values of the sensor and the amount of liquid within the liquid storing section themselves. Instead, the storage section may store data form which the output values and the amount of liquid can be derived.

In addition, without departing from the scope of the claims, the configurations (shapes, positions, etc.) of each part (the housing 41, the reservoir 42, the supply pipe 43, the plug 50, the valve 60, the sensor unit 70, the memory 141, the board 142, etc.) of the cartridge may be changed appropriately. Further, other parts may be added, and some parts may be omitted.

<Modifications Regarding Controls Performed by the Apparatus Main Unit>

The apparatus main unit may stop an operation of each section of the apparatus main unit (an ejecting operation of the head, etc.), without reporting an error.

Timing at which transmission and reception of signals are allowed between the cartridge and the apparatus main unit and timing at which power supply is allowed from the apparatus main unit to the cartridge are not limited to those described above. The timings can be changed arbitrarily.

In the above-described embodiment, the mounting detection switch 159 of a mechanical-sensor type is used as the mounting detection section for detecting that the cartridge is mounted on the mounting section. However, another component may be used. For example, an optical sensor, a switch that outputs an ON signal when the printer and the cartridge are electrically connected, or the like may be used.

Writing of data by the writing section and determination of abnormality by the abnormal-writing determining section may be performed prior to reception of a print command from an external device.

Timing at which each section performs a function, such as timing at which the reading section reads data stored in the storage section of the cartridge, timing at which the writing section writes data in the storage section of the cartridge, timing at which the receiving section receives a signal from the sensor, timing at which the abnormal-writing determining section determines abnormal writing, timing at which the abnormal-reception determining section determines abnormal reception, timing at which the moving section moves the hollow member, and the like may be changed appropriately, without departing from the scope of the claims.

The hollow member may have a tip that is not acicular like a needle.

Liquid stored in the liquid cartridge is not limited to ink and pre-coat liquid. For example, the liquid may be post-coat liquid that is ejected onto a recording medium subsequent to recording in order to improve image quality, cleaning liquid for cleaning the conveying belt, and the like.

The number of the cartridge(s) included in a liquid ejecting device may be one or more.

The number of the liquid ejecting head(s) included in a liquid ejecting device is not limited to two, but may be one or more. For example, the liquid ejecting device may be a color inkjet printer including heads that eject black ink and ink in three colors (magenta, cyan, and yellow). The liquid ejecting device may be a line type or a serial type. Further, the liquid ejecting device is not limited to a printer, but may be any liquid ejecting device such as a facsimile apparatus, a copier, and the like.

What is claimed is:

1. A liquid cartridge comprising:

a housing having a space therein;

a liquid storing section provided in the housing and configured to store liquid;

a channel member provided in the housing and formed with a liquid channel having one end and another end, the one end being in fluid communication with the liquid storing section, the another end being in fluid communication with outside to serve as a discharge port for discharging liquid to the outside;

a movable member that is movable in the liquid channel;

a sensor configured to generate a signal based on a position of the movable member in the liquid channel;

a sensor-signal output terminal connected electrically with the sensor and configured to output the signal to the outside; and a wiring line that connects the sensor with the sensor-signal output terminal, wherein the housing comprises:

a first outer surface; and a second outer surface and a third outer surface each connecting to the first outer surface and intersecting the first outer surface, the second outer surface and the third outer surface being spaced from and in confrontation with each other;

wherein the sensor-signal output terminal is disposed on the first outer surface;

wherein the discharge port is disposed on the second outer surface;

wherein the channel member is disposed at a position closer to the second outer surface than the liquid storing section is;

wherein the liquid storing section is disposed at a position closer to the third outer surface than the channel member is;

wherein a first direction is defined as a direction perpendicular to the first outer surface, a second direction is defined as a direction perpendicular to the second outer surface, and a third direction is defined as a direction perpendicular to both the first direction and the second direction;

wherein, when the space in the housing is divided by an imaginary line parallel to the first direction, as viewed from the third direction, into a first region in which the channel member is disposed and a second region in which the liquid storing section is disposed, the sensor and the sensor-signal output terminal are disposed in the first region;

wherein the liquid channel extends linearly in the second direction; and wherein the sensor and the sensor-signal output terminal are arranged to be aligned in the first direction.

2. The liquid cartridge according to claim 1, wherein the wiring line is disposed in the first region as viewed from the third direction.

3. The liquid cartridge according to claim 1, wherein the first outer surface is formed with a concave section having a bottom surface; and wherein the sensor-signal output terminal is disposed on the bottom surface.

4. The liquid cartridge according to claim 1, wherein the liquid storing section comprises a plurality of liquid storing sections;

wherein the sensor comprises a plurality of sensors corresponding to respective ones of the plurality of liquid storing sections; and wherein the liquid cartridge further comprises a flexible cable that connects each of the plurality of sensors with one another, the wiring line for the plurality of sensors being formed on the flexible cable.

5. The liquid cartridge according to claim 4, further comprising:

a power input terminal connected electrically with the plurality of sensors via the flexible cable and configured to input electrical power from outside; and a ground terminal connected electrically with the plurality of sensors via the flexible cable and connected with ground, wherein the plurality of sensors shares the power input terminal and the ground terminal.

6. The liquid cartridge according to claim 4, wherein the flexible cable has one end and another end that is farther from the sensor-signal output terminal than the one end is;

wherein the liquid cartridge further comprises a plurality of boards fixed to the flexible cable at positions spaced from each other between the one end and the another end of the flexible cable, the plurality of sensors being mounted on respective ones of the plurality of boards;

wherein the plurality of boards comprises a first board and a second board that is closer to the another end of the flexible cable than the first board is; and wherein the wiring line for the sensor mounted on the second board extends to the second board via the first board.

7. The liquid cartridge according to claim 6, wherein the flexible cable extends substantially in the first direction in the first region; and wherein the wiring line is connected with the sensor-signal output terminal at the one end of the flexible cable.

8. The liquid cartridge according to claim 1, further comprising a plug provided at the discharge port and configured to selectively allow liquid to flow via the plug and prevent liquid from flowing via the plug, wherein the plug comprises an elastic member configured such that a hollow member can penetrate therethrough to allow liquid to flow via the plug.

9. The liquid cartridge according to claim 1, wherein the first outer surface is a surface at a downstream side in a mounting direction in which the liquid cartridge is mounted to a main unit of a liquid ejecting apparatus.

10. The liquid cartridge according to claim 1, wherein the movable member is configured to selectively move in the second direction between a closed position and an open position; and wherein, when the movable member is in the closed position, the movable member is configured to prevent fluid communication between an interior of the liquid storing section and an exterior of the liquid storing section.

11. The liquid cartridge according to claim 10, wherein, when the movable member is in the closed position, the movable member is aligned with a center of the sensor in the second direction and, when the movable member is in the open position, the movable member is not aligned with the center of the sensor in the second direction.

12. The liquid cartridge according to claim 1, wherein the sensor comprises a magnetic sensor configured to selectively output a first signal and a second signal based on a magnetic flux density;

wherein the liquid cartridge further comprises an interacting portion configured to magnetically interact with the magnetic sensor to change the magnetic flux density at the magnetic sensor; and wherein the movable member is the interacting portion.

13. The liquid cartridge according to claim 1, further comprising a storage section configured to store data relating to at least one characteristic of the liquid cartridge, wherein the storage section is disposed in the first region.

14. A liquid cartridge comprising:

a housing having a space therein;

a liquid storing section provided in the housing and configured to store liquid;

a channel member provided in the housing and formed with a liquid channel having one end and another end, the one end being in fluid communication with the liquid storing section, the another end being in fluid communication with outside to serve as a discharge port for discharging liquid to the outside;

a movable member that is movable in the liquid channel;

a sensor configured to generate a signal based on a position of the movable member in the liquid channel;

a sensor-signal output terminal connected electrically with the sensor and configured to output the signal to the outside; and a wiring line that connects the sensor with the sensor-signal output terminal, wherein the housing comprises:

a first outer surface; and a second outer surface and a third outer surface each connecting to the first outer surface and intersecting the first outer surface, the second outer surface and the third outer surface being spaced from and in confrontation with each other;

wherein the sensor-signal output terminal is disposed on the first outer surface;

wherein the discharge port is disposed on the second outer surface;

wherein the channel member is disposed at a position closer to the second outer surface than the liquid storing section is;

wherein the liquid storing section is disposed at a position closer to the third outer surface than the channel member is;

wherein a first direction is defined as a direction perpendicular to the first outer surface, and a second direction is defined as a direction perpendicular to the second outer surface;

wherein, when the space in the housing is divided by an imaginary line parallel to the second outer surface, as viewed from a direction parallel to both the first outer surface and the second outer surface, into a first region in which the channel member is disposed and a second region in which the liquid storing section is disposed, the sensor and the sensor-signal output terminal are disposed in the first region;

wherein the liquid channel extends linearly in the second direction; and wherein the sensor and the sensor-signal output terminal are arranged to be aligned in the first direction.

15. A liquid cartridge comprising:

a housing having a space therein;

a liquid storing section provided in the housing and configured to store liquid;

a channel member provided in the housing and formed with a liquid channel having one end and another end, the one end being in fluid communication with the liquid storing section, the another end being in fluid communication with outside to serve as a discharge port for discharging liquid to the outside, the channel member being so configured that a hollow member can be inserted through the discharge port;

a sensor configured to generate a signal based on a position of the hollow member in the liquid channel;

a sensor-signal output terminal connected with the sensor and configured to output the signal to the outside; and a wiring line that connects the sensor with the sensor-signal output terminal, wherein the housing comprises:

a first outer surface; and a second outer surface and a third outer surface each connecting to the first outer surface and intersecting the first outer surface, the second outer surface and the third outer surface being spaced from and in confrontation with each other;

wherein the sensor-signal output terminal is disposed on the first outer surface;

wherein the discharge port is disposed on the second outer surface;

wherein the channel member is disposed at a position closer to the second outer surface than the liquid storing section is;

wherein the liquid storing section is disposed at a position closer to the third outer surface than the channel member is;

wherein a first direction is defined as a direction perpendicular to the first outer surface, a second direction is defined as a direction perpendicular to the second outer surface, and a third direction is defined as a direction perpendicular to both the first direction and the second direction;

wherein, when the space in the housing is divided by an imaginary line parallel to the first direction, as viewed from the third direction, into a first region in which the channel member is disposed and a second region in which the liquid storing section is disposed, the sensor and the sensor-signal output terminal are disposed in the first region;

wherein the liquid channel extends linearly in the second direction; and wherein the sensor and the sensor-signal output terminal are arranged to be aligned in the first direction.

* * * * *